US006528930B1

(12) United States Patent
Chang et al.

(10) Patent No.: US 6,528,930 B1
(45) Date of Patent: Mar. 4, 2003

(54) CONDUCTIVE FOCUS WAFFLE

(75) Inventors: David C. Chang, San Jose, CA (US); Arthur J. Learn, Cupertino, CA (US); Bob L. Mackey, San Jose, CA (US); Paul M. Drumm, San Jose, CA (US); David L. Morris, San Jose, CA (US)

(73) Assignee: Candescent Intellectual Property Services, Inc., San Jose, CA (US)

( * ) Notice: Subject to any disclaimer, the term of this patent is extended or adjusted under 35 U.S.C. 154(b) by 0 days.

(21) Appl. No.: 09/660,318

(22) Filed: Sep. 12, 2000

Related U.S. Application Data

(62) Division of application No. 09/087,105, filed on May 29, 1998, now Pat. No. 6,176,754.

(51) Int. Cl.[7] ..... H01J 9/16
(52) U.S. Cl. ..... 313/310; 313/309
(58) Field of Search ..... 313/495, 496, 313/497, 309, 336, 351, 310; 445/24, 47

(56) References Cited

U.S. PATENT DOCUMENTS 5,528,103 A * 6/1996 Spindt et al. ..... 313/497
5,650,690 A * 7/1997 Haven ..... 313/495
5,920,151 A * 7/1999 Barton et al. ..... 313/497
6,002,199 A * 12/1999 Spindt et al. ..... 313/309
6,010,383 A * 1/2000 Knall ..... 445/24

* cited by examiner

*Primary Examiner*—Michael H. Day
(74) *Attorney, Agent, or Firm*—Wagner, Murabito & Hao LLP

(57) ABSTRACT

A conductive focus waffle structure for focusing electrons emitted from a cathode portion of a flat panel display device. In one embodiment, the conductive focus waffle structure comprises a grid of material comprised of substantially orthogonally oriented rows and columns. The substantially orthogonally oriented rows and columns define openings therebetween having sufficient size to allow electrons emitted from a cathode portion of a flat panel display device to pass therethrough. The focus waffle grid further comprises a lower dielectric portion adapted to be coupled to the cathode portion of the flat panel display device and an upper conductive portion coupled to the lower dielectric portion, the upper conductive portion adapted to focus the electrons passing through the openings.

4 Claims, 37 Drawing Sheets

CONDUCTIVE FOCUS WAFFLE

This is a divisional of application(s) Ser. No. 09,087,105 filed on May 29, 1998, now U.S. Pat. No. 6,176,754 B1.

FIELD OF THE INVENTION

The present claimed invention relates to the field of flat panel displays. More particularly, the present claimed invention relates to the "focus waffle" of a flat panel display screen structure.

BACKGROUND ART

Flat panel display devices often operate using electron emitting structures, such as, for example, Spindt-type field emitters. These types of flat panel displays often employ a polyimide structure to focus or define the path of electrons emitted from the electron emitting structures. In one prior art approach, the polyimide structure is referred to as a "focus waffle." The structure is comprised of a plurality of rows which are parallel to each other and a plurality of columns which are parallel to each other but which are substantially orthogonal to the plurality of rows. The plurality of rows and columns of polyimide material define openings therebetween. The focus waffle is disposed between the electron emitting structures and the faceplate such that emitted electrons pass through openings in the focus waffle structure, and are directed towards corresponding sub-pixel regions.

Unfortunately, such prior art polyimide focus waffle structures are extremely expensive and, thus, introduce additional costs for flat panel display fabrication. As yet another disadvantage, such prior art polyimide focus waffle structures are a major source of contamination in flat panel display devices. That is, such "dirty" polyimide focus waffle structures introduce contaminate particles into the evacuated environment of the flat panel display device. These contaminate particles degrade the performance of the flat panel display device, may cause discoloration, and reduce the effective lifetime of the flat panel display device. In addition to emitting contaminate particles, such prior art focus waffle structures also outgas material (e.g. organics) due to electron desorbtion and thermal stresses induced during flat panel display fabrication steps.

As yet another drawback, the application of conductive coatings (e.g. aluminum) applied to polyimide focus waffle structures introduces considerable difficulty and complexity during the fabrication of conventional flat panel display devices. More specifically, in conventional flat panel display fabrication, the conductive coatings are applied using an angled evaporation process. The angled evaporation process is difficult, time-consuming, and expensive. In addition to being difficult to perform, the time-consuming nature of the angled evaporation process reduces throughput and yield during the fabrication of flat panel display devices.

Thus, a need exists for a focus waffle structure which does not suffer from significant expense, contaminate emission, and outgassing. A further need exists for a focus waffle structure which meets the above-listed need and also eliminates the requirement for complex and difficult angled evaporation processing steps. Still another need exists for a focus waffle structure which meets the above-listed needs and further improves focus waffle manufacturing throughput and yield.

SUMMARY OF INVENTION

The present invention provides a focus waffle structure which does not suffer from significant contaminate emission and outgassing. The present invention further provides a focus waffle structure which also eliminates the requirement for complex and difficult angled evaporation processing steps. Additionally, the present invention also invention provides a focus waffle structure which improves focus waffle manufacturing throughput and yield. The invention described herein provides a conductive focus waffle structure for focusing electrons emitted from a cathode portion of a flat panel display device, and a method for forming the conductive focus waffle structure. Also, it will be understood that the focus waffle structure of the present invention is applicable in numerous types of flat panel displays.

Specifically, in one embodiment, the present invention applies a first layer of photo-imagable material above a cathode portion of a flat panel display device. This embodiment then removes portions of the layer of photo-imagable material such that openings are formed therein. A layer of conductive material is then applied over the cathode such that conductive material is disposed within the openings in the layer of photo-imagable material. A dielectric layer of material is also disposed between the cathode and the bottom surface of the conductive material. This embodiment of the present invention then removes the layer of photo-imagable material such that at least a portion of the conductive focus waffle structure is formed disposed above the cathode. In so doing, at least a first portion of a conductive focus waffle structure is formed.

In one embodiment, the present invention includes the steps of the above-described embodiment and further recites applying dielectric material above said cathode portion before applying photo-imagable material. In so doing, the layer of photo-imagable material is separated from the cathode portion of the flat panel display device by the layer of dielectric material. Thus, the conductive material disposed into the openings in the layer of the photo-imagable material is not in direct electrical contact with the cathode portion of the flat panel display device.

In still another embodiment, the present invention includes the steps of the first above-described embodiment and further recites applying dielectric material into the openings formed in the photo-imagable material prior to applying the conductive material above the photo-imagable material. In so doing, the conductive material disposed into the openings in the layer of the photo-imagable material is not in direct electrical contact with the cathode portion of the flat panel display device.

These and other benefits and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

The drawings referred to in this description should be understood as not being drawn to scale except if specifically noted.

DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail so as not to unnecessarily obscure aspects of the present invention.

Figure 1A:
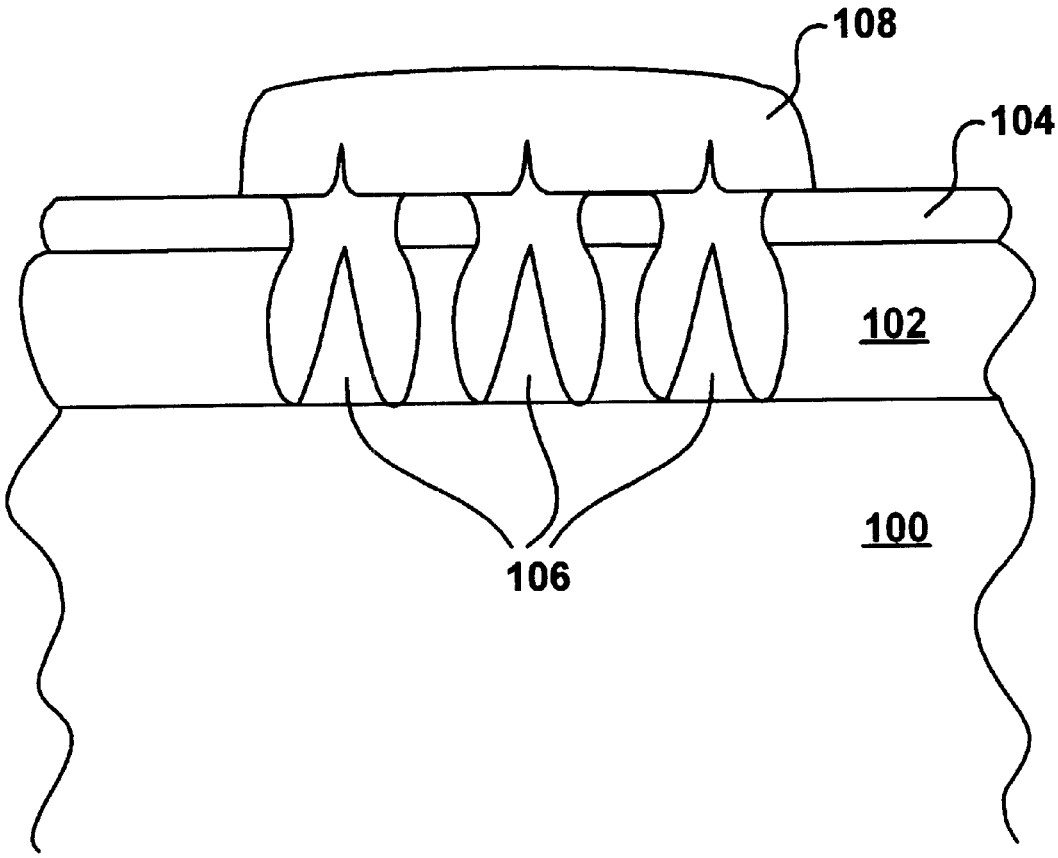
FIG. 1A shows a side sectional view depicting one starting point in a conductive focus waffle formation method in accordance with one embodiment of the present claimed invention.

With reference now to FIG. 1A, a side sectional view depicting a starting point in the conductive focus waffle formation method of one embodiment of the present claimed invention is shown. It will be understood that for purposes of clarity, certain features well known in the art will not be depicted in the following figures or discussed in detail in the following description. In the present embodiment, part of a cathode portion of a field emission display is shown. Specifically, in FIG. 1A, a substrate 100 has a row electrode (not shown) disposed thereon. The present invention is also well suited to various other configurations in which, for example, the row electrode has a resistive layer (not shown) disposed thereover. An inter-metal dielectric layer 102, comprised, for example, of silicon dioxide, is disposed above the row electrode. A conductive gate electrode layer 104 resides above inter-metal dielectric layer 102. Field emitter structures, typically shown as 106, are formed within respective cavities in inter-metal dielectric layer 102. Additionally, a closure layer 108 covers the cavities in inter-metal dielectric layer 102 and protects field emitters 106 during subsequent processing steps.

Figure 1B:
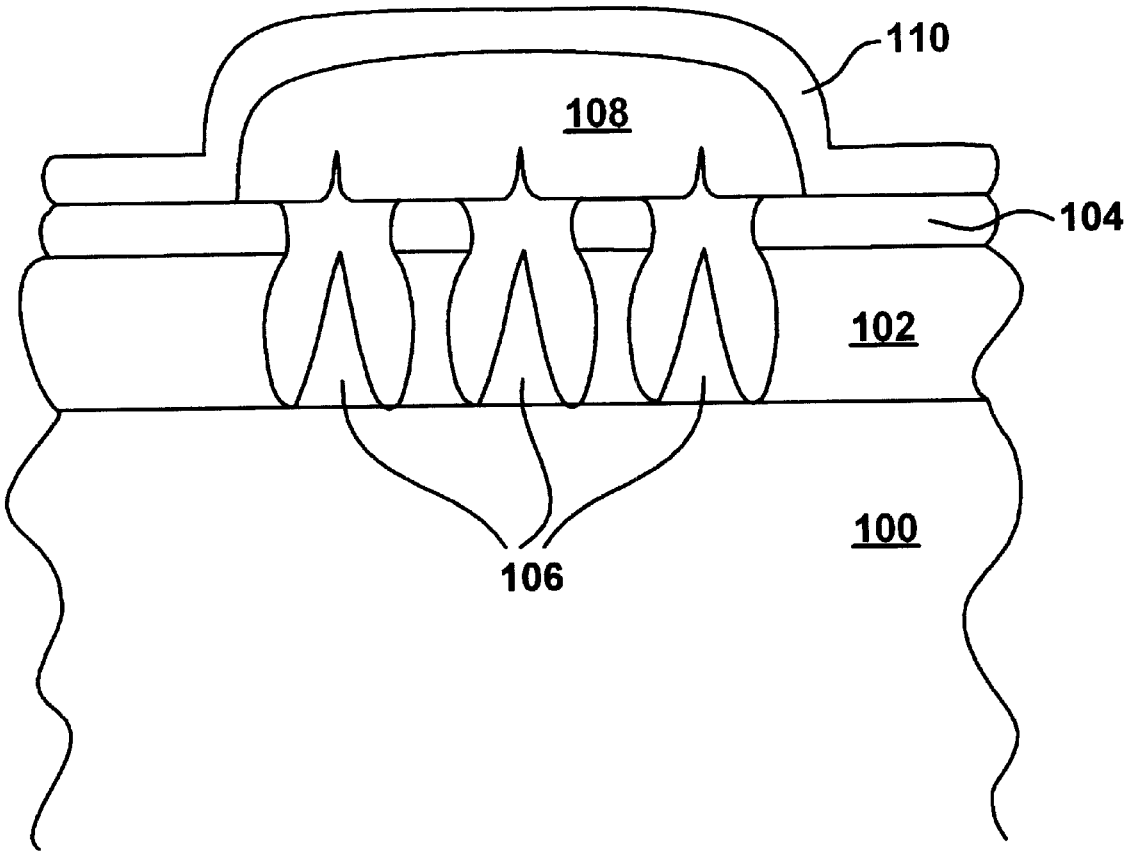
FIG. 1B shows a side sectional view of the structure of FIG. 1A having a layer of dielectric material disposed thereabove in accordance with one embodiment of the present claimed invention.

Referring now to FIG. 1B, in one embodiment of the present invention a layer of insulating material 110 (e.g. a layer of dielectric material) is applied above said cathode portion. In the present embodiment, the layer of insulating material 110 is, for example, spin-on-glass (SOG). The present invention is, however, well suited to applying various other types of insulating material above the cathode portion of FIG. 1A. In this embodiment, layer of insulating material 110 is deposited to a depth of approximately 5–50 microns.

Figure 1C:
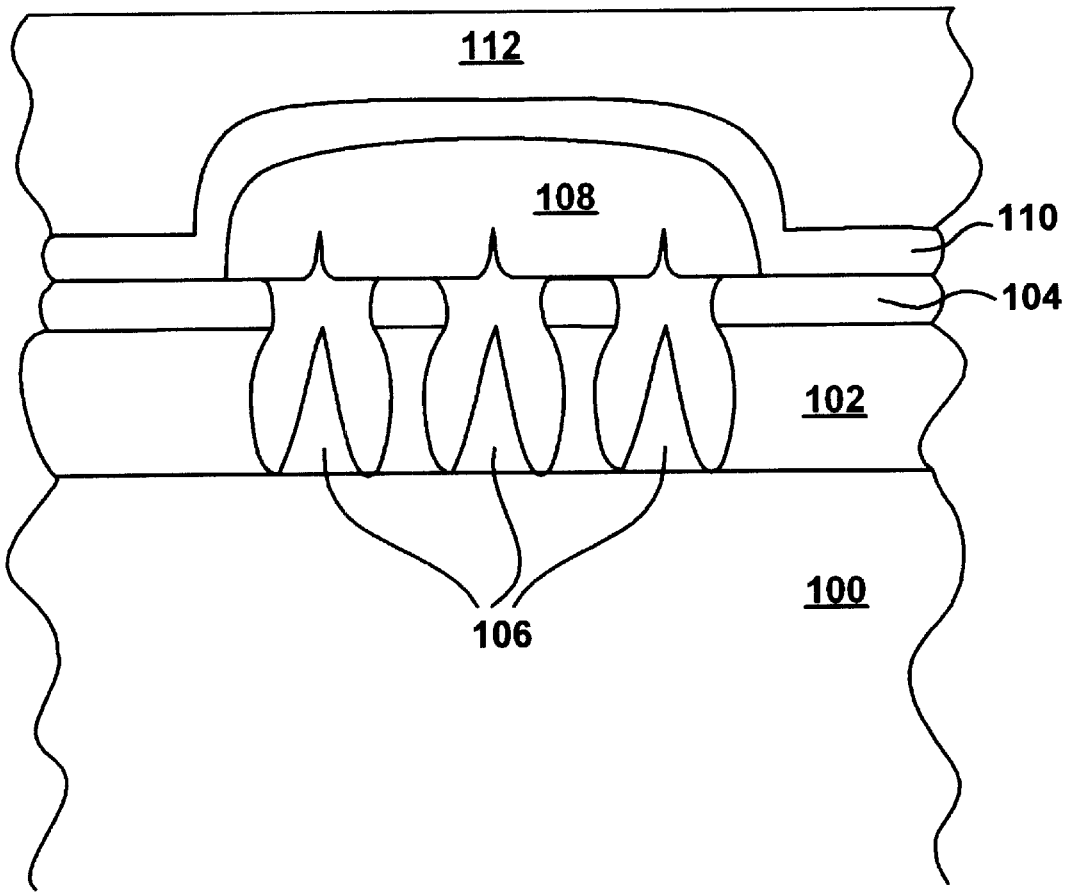
FIG. 1C shows a side sectional view of the structure of FIG. 1B having a layer of photo-imagable material disposed thereabove in accordance with one embodiment of the present claimed invention.

With reference now to FIG. 1C, in the present embodiment of the invention, a layer 112 of photo-imagable material is applied above dielectric layer 110 of the cathode portion of FIG. 1B. In the present embodiment, layer 112 of photo-imagable material is comprised of photoresist such as, for example, AZ4620 Photoresist, available from Hoechst-Celanese of Somerville, N.J. It will be understood, however, that the present invention is well suited to the use of various other types and suppliers of photo-imagable material. Layer 112 of photoresist is deposited to a depth of approximately 40–100 microns in the present embodiment.

Figure 1D:
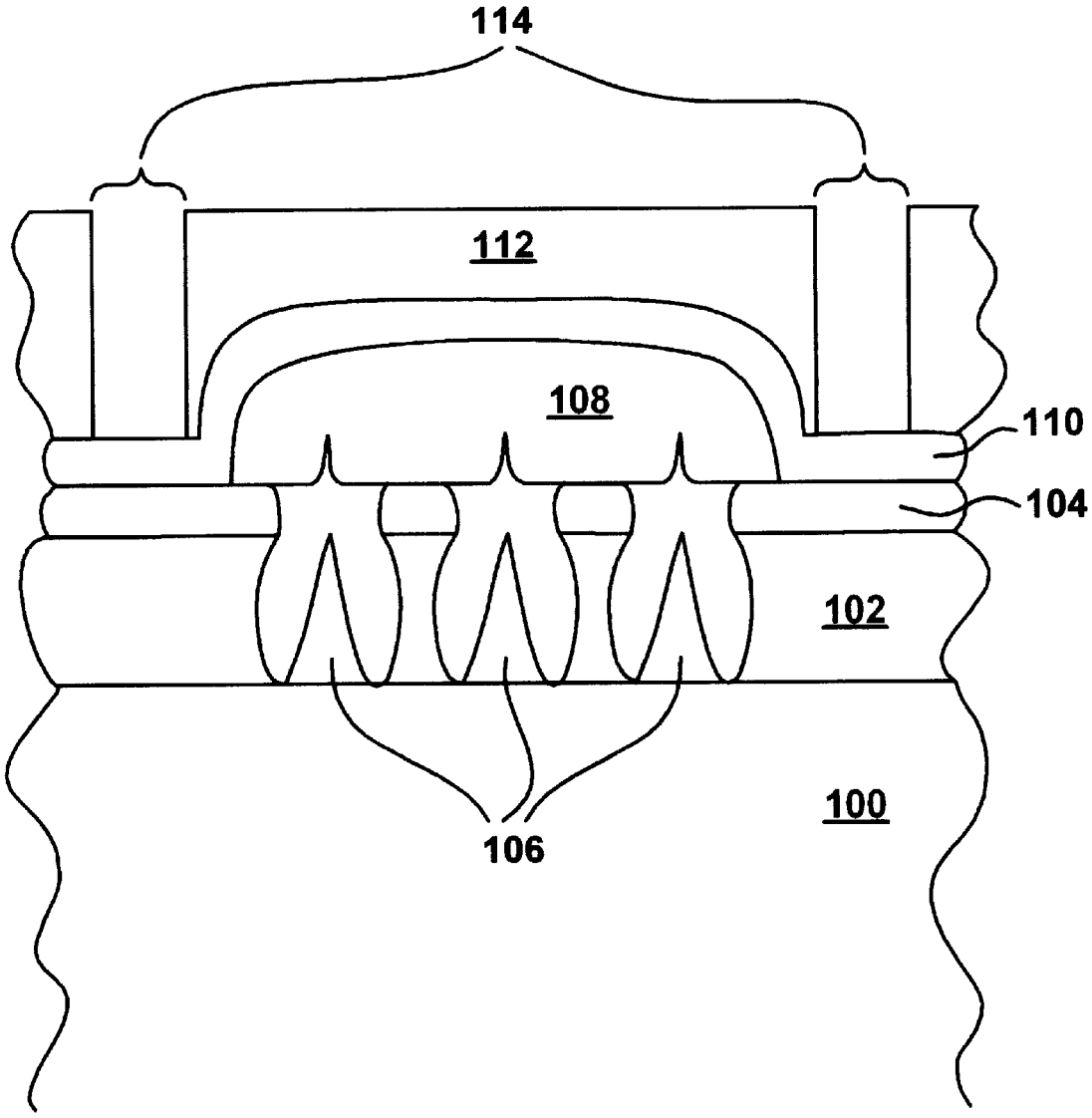
FIG. 1D shows a side sectional view of the structure of FIG. 1C having openings formed in the layer of photo-imagable material in accordance with one embodiment of the present claimed invention.

With reference next to FIG. 1D, after the deposition of layer of photo-imagable material 112, layer of photo-imagable material 112 is subjected to an exposure process. After the exposure process, the present embodiment removes portions of layer of photo-imagable material 112, such that openings, typically shown as 114 in the side sectional view of FIG. 1D, are formed in layer of photo-imagable material 112. In the present embodiment, openings 114 form a template for the formation of a conductive focus waffle structure. That is, openings 114 are disposed in a grid pattern comprised of substantially orthogonally oriented rows and columns. Furthermore, although only two openings, 114, are shown in FIG. 1D for purposes of clarity, it will be understood that numerous rows and columns of openings will be formed into layer of photo-imagable material 112.

Figure 2:
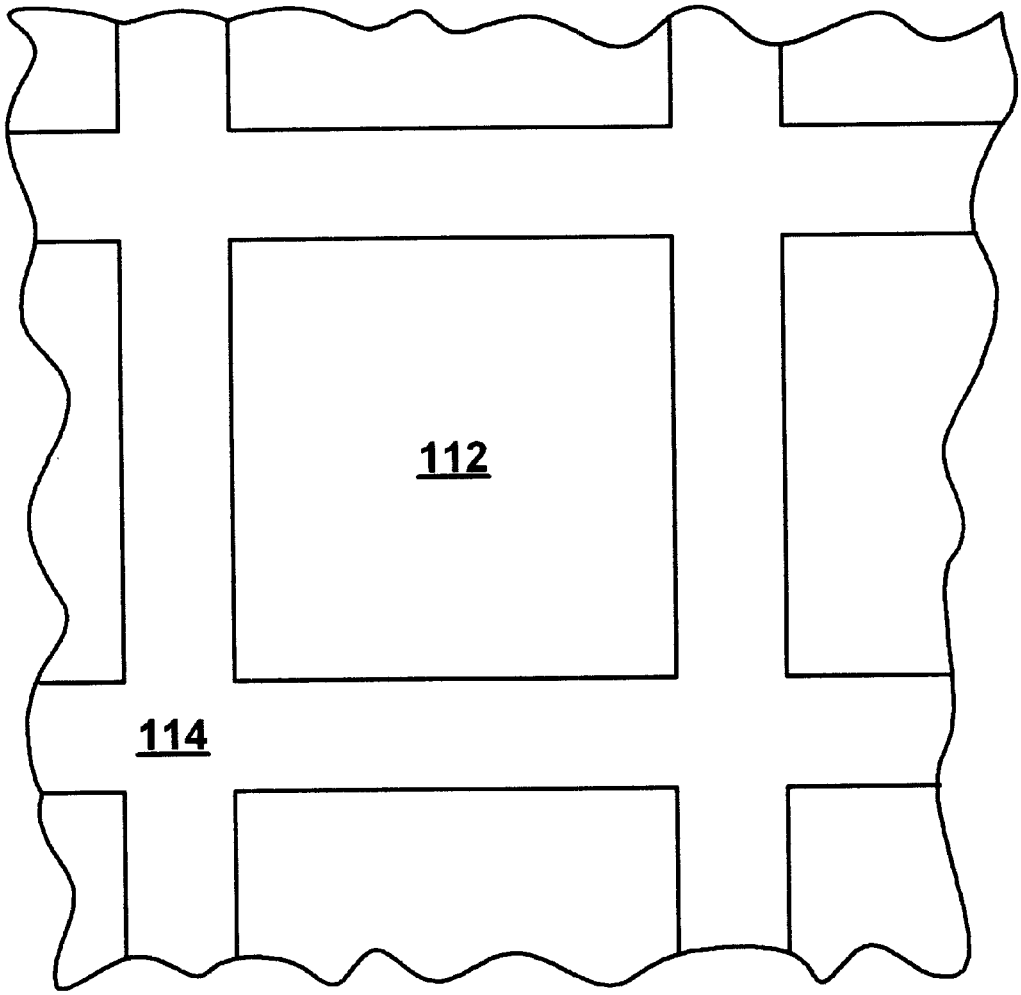
FIG. 2 is a top plan view of openings formed in a layer of photo-imagable material in accordance with one embodiment of the present claimed invention.

Referring next to FIG. 2, a top plan view of the embodiment of FIG. 1D is shown in which openings 114 are formed into layer of photo-imagable material 112. As shown in FIG. 2, openings 114 are disposed in the locations where a conductive focus waffle structure is to be formed in accordance with the present invention.

Figure 1E:
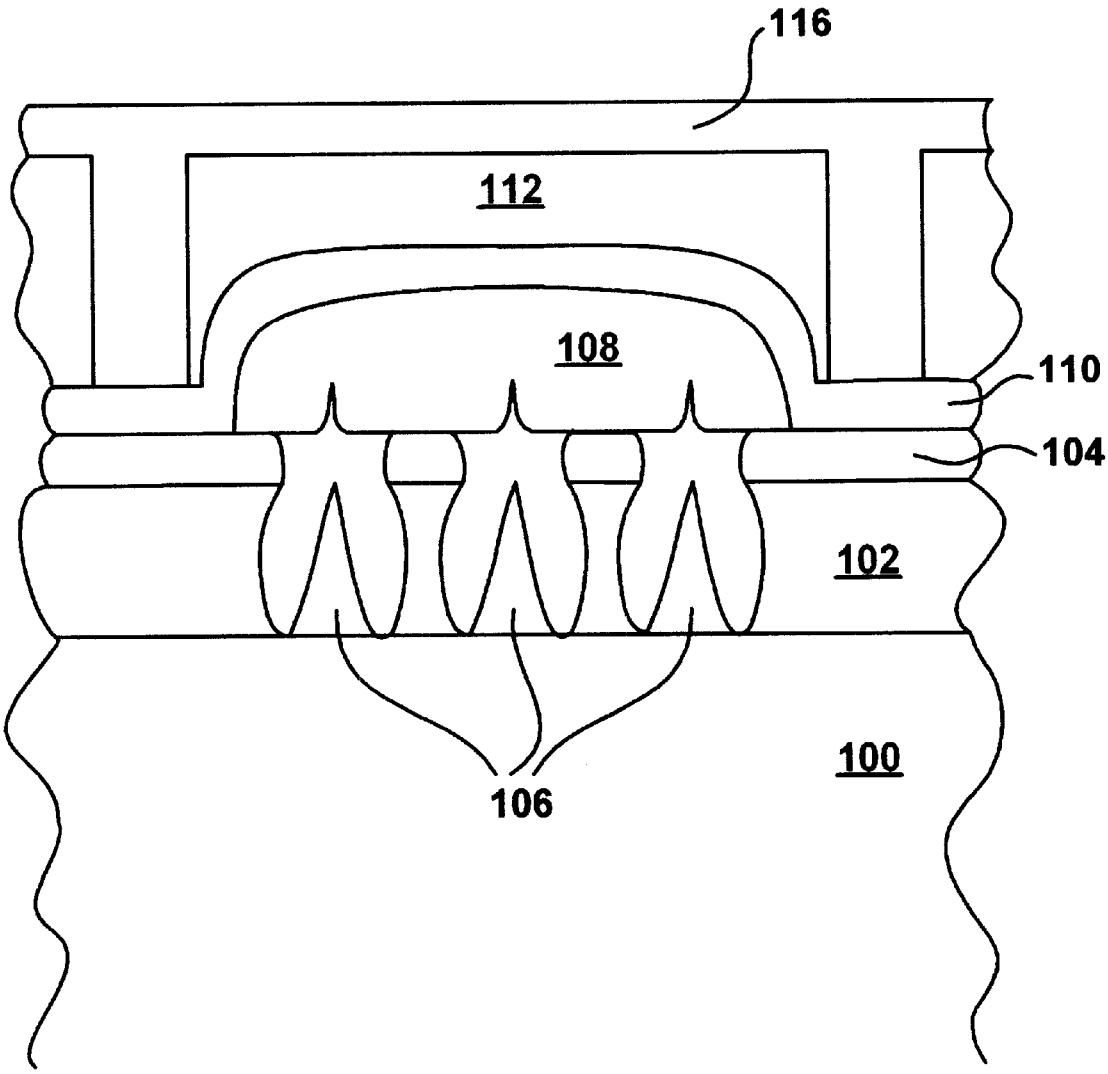
FIG. 1E shows a side sectional view of the structure of FIG. 1D having a conductive layer disposed over the layer of photo-imagable material and into the openings formed therein in accordance with one embodiment of the present claimed invention.

Referring now to FIG. 1E, after the formation of openings 114 of FIG. 1C and FIG. 2, the present embodiment applies a layer of conductive material 116 over layer of photo-imagable material 112 and into openings 114 formed therein. As shown in FIG. 1E, layer of conductive material 116 is electrically insulated from conductive gate electrode layer 104 by layer of insulating material 110. In the present embodiment, layer of conductive material 116 is comprised, for example, of a CB800A DAG made by Acheson Colloids of Port Huron, Mich. In another embodiment, layer of conductive material 116 is comprised of a different graphite-based conductive material. In still another embodiment, the layer of graphite-based conductive material is applied as a semi-dry spray to reduce shrinkage of layer of conductive material 116. In such an embodiment, the present invention allows for improved control over the final depth of layer of conductive material 116. Although such deposition methods are recited above, it will be understood that the present invention is also well suited to using various other deposition methods to deposit various other conductive materials over layer of photo-imagable material 112 and into openings 114 formed in layer of photo-imagable material 112.

Figure 1F:
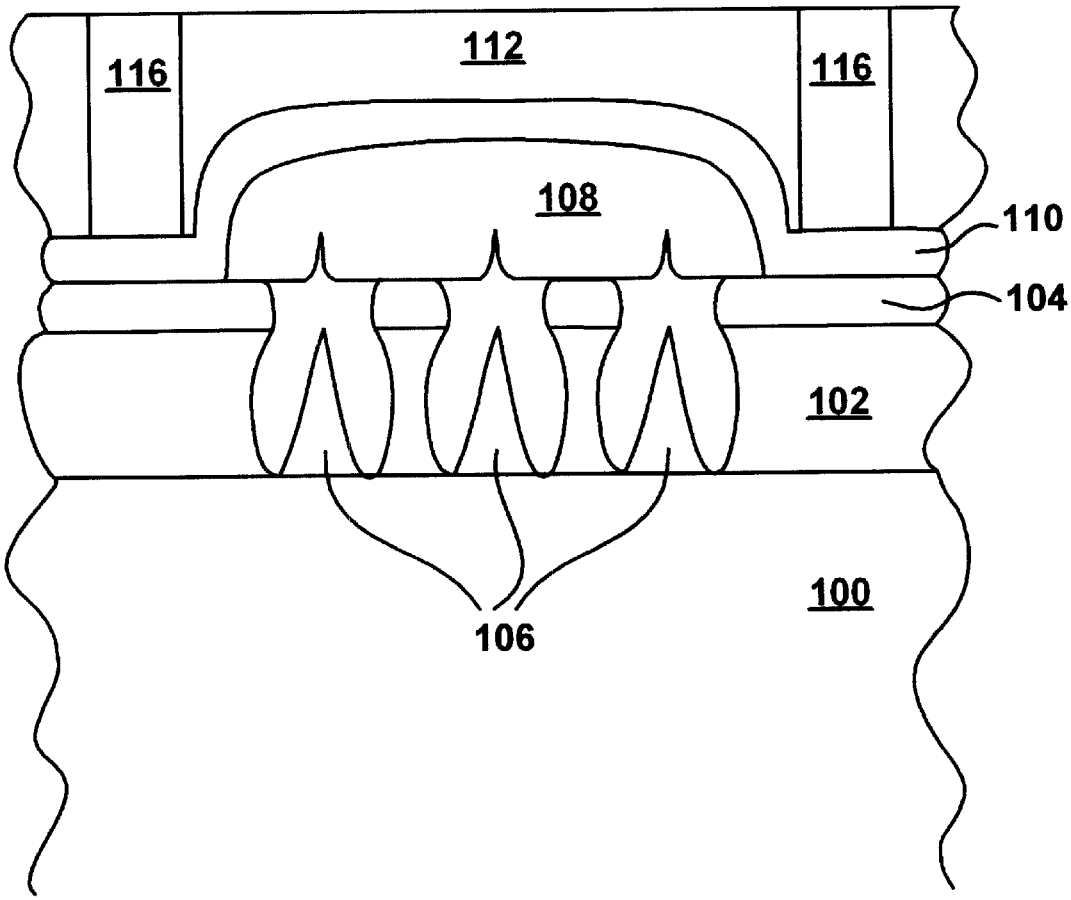
FIG. 1F shows a side sectional view of the structure of FIG. 1E having excess portions of conductive layer removed therefrom in accordance with one embodiment of the present claimed invention.

With next to FIG. 1F, in one embodiment of the present invention, excess conductive material disposed on top of and/or into openings 114 in layer of photo-imagable material 112 is removed by wiping off (e.g. "squeegeeing" and the like) the conductive material from the top surface of layer of photo-imagable material 112. In so doing, the present embodiment insures that layer of conductive material 116 is at a desired depth within openings 114 in layer of photo-imagable material 112. After the removal of excess conductive material, layer of conductive material 116 is hardened. In the present embodiment, layer of conductive material 116 is baked at approximately 80–90 degrees Celsius for approximately 4–5 minutes. In another embodiment, excess conductive material disposed on top of and/or in openings 114 in layer of photo-imagable material 112 is removed by mechanically polishing off the excess amounts of the conductive material after the hardening process. Again, such an approach insures that the conductive material is deposited to a desired depth within openings 114 in layer of photo-imagable material 112.

Figure 1G:
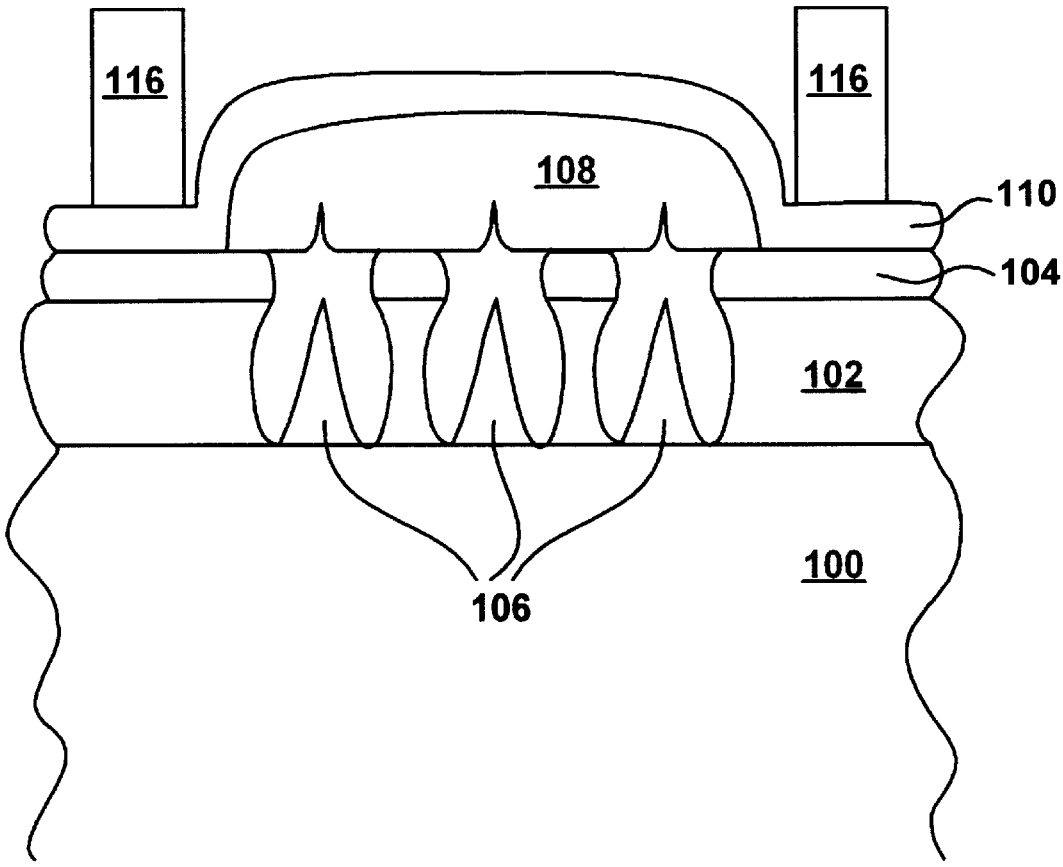
FIG. 1G shows a side sectional view of the structure of FIG. 1F having remaining portions of photo-imagable layer of material removed therefrom in accordance with one embodiment of the present claimed invention.

Referring now to FIG. 1G, after layer of conductive material 116 is hardened, the present invention removes remaining portions of layer of photo-imagable material 112. In the present embodiment, a technical grade acetone is applied to layer of photo-imagable material 112 to facilitate the removal process. The present invention is well suited to removing photo-imagable material using numerous other solvents such as 400T photoresist stripper of available from Hoechst-Celanese of Somerville, N.J., NMP stripper and the like. After the removal of the remaining portions of layer of photo-imagable material 112, conductive rows and columns 116 remain disposed above layer of insulating material 110.

Figure 1H:
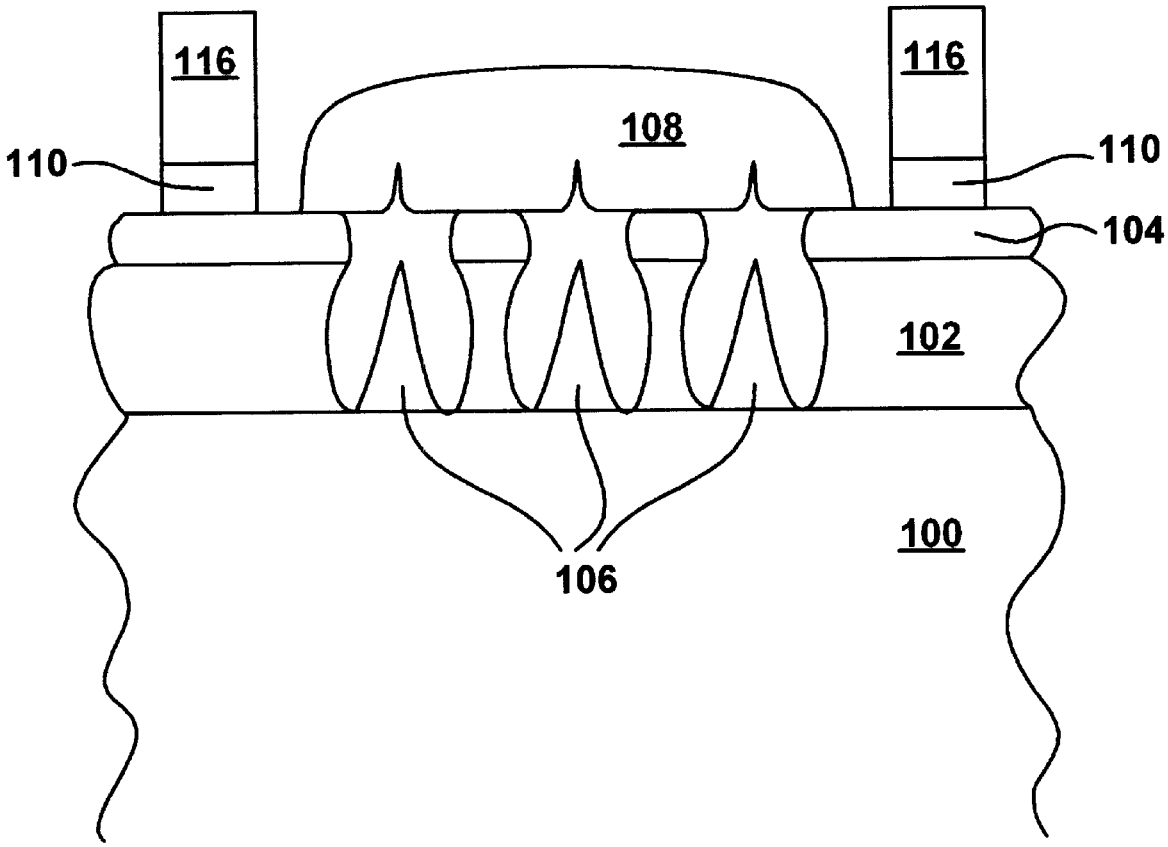
FIG. 1H shows a side sectional view of the structure of FIG. 1G having various portions of the insulating layer of material removed therefrom in accordance with one embodiment of the present claimed invention.

As shown in FIG. 1H, after the removal of the remaining portions of layer of photo-imagable material 112, the present embodiment removes layer of insulating material 110 except for those portions of layer of insulating material 110 which directly underlie conductive rows and columns 116. As a result, the present embodiment provides a complete conductive focus waffle structure which is electrically insulated from conductive gate electrode layer 104 by portions of layer of insulating material 110. Moreover, the conductive focus waffle structure of the present embodiment includes a lower dielectric portion (comprised of a portion of layer of insulating material 110) and an upper conductive portion (comprised of conductive material disposed in openings 114 of photo-imagable layer 112 of FIGS. 1C–1F). In the present embodiment, the substantially orthogonally oriented rows and columns of the conductive focus waffle structure are formed having a height of approximately 40–100 microns. Also, the substantially orthogonally oriented rows and columns define openings therebetween, wherein the openings having sufficient size to allow electrons emitted from field emitters 106 to pass therethrough. It will be understood that by applying a potential to the present conductive focus waffle structure, electrons emitted from field emitters 106 are directed towards respective sub-pixel regions.

The present embodiment has several substantial benefits associated therewith. For example, by using the aforementioned graphite-based conductive material to form the conductive focus waffle structure, the present invention eliminates deleterious browning and outgassing associated with prior art polyimide based waffle structures. Additionally, the conductive material utilized in the present invention can be subjected, without damage thereto, to higher processing temperatures than can be used when the waffle structure is formed of polyimide. Furthermore, the conductive focus waffle structure of the present embodiment does not require the use of expensive polyimide material, and the conductive focus waffle structure of the present embodiment eliminates the need for a complex and difficult angled evaporation process.

Figure 3A:
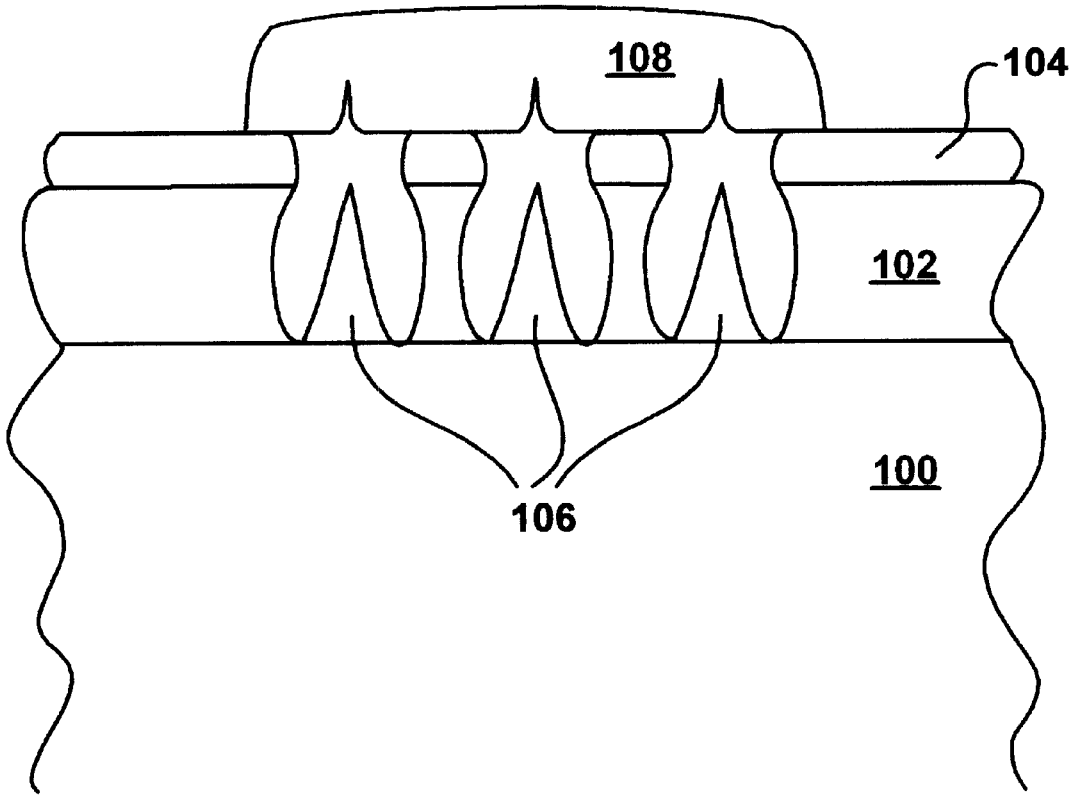
FIG. 3A shows a side sectional view depicting one starting point in a conductive focus waffle formation method in accordance with one embodiment of the present claimed invention.

With reference now to FIG. 3A, a side sectional view depicting a starting point in the conductive focus waffle formation method of one embodiment of the present claimed invention is shown. The structure of FIG. 3A is similar to or identical to the structure of FIG. 1A. Furthermore, it will be understood that for purposes of clarity, certain features well known in the art will not be depicted in the following figures or discussed in detail in the following description. In the embodiment of FIG. 3A, part of a cathode portion of a field emission display is shown. Specifically, in FIG. 3A, a substrate 100 has a row electrode (not shown) disposed thereon. The present invention is also well suited to various other configurations in which, for example, the row electrode has a resistive layer (not shown) disposed thereover. An inter-metal dielectric layer 102, comprised, for example, of silicon dioxide, is disposed above the row electrode. A conductive gate electrode layer 104 resides above inter-metal dielectric layer 102. Field emitter structures, typically shown as 106, are formed within respective cavities in inter-metal dielectric layer 102. Additionally, a closure layer 108 covers the cavities in inter-metal dielectric layer 102 and protects field emitters 106 during subsequent processing steps.

Figure 3B:
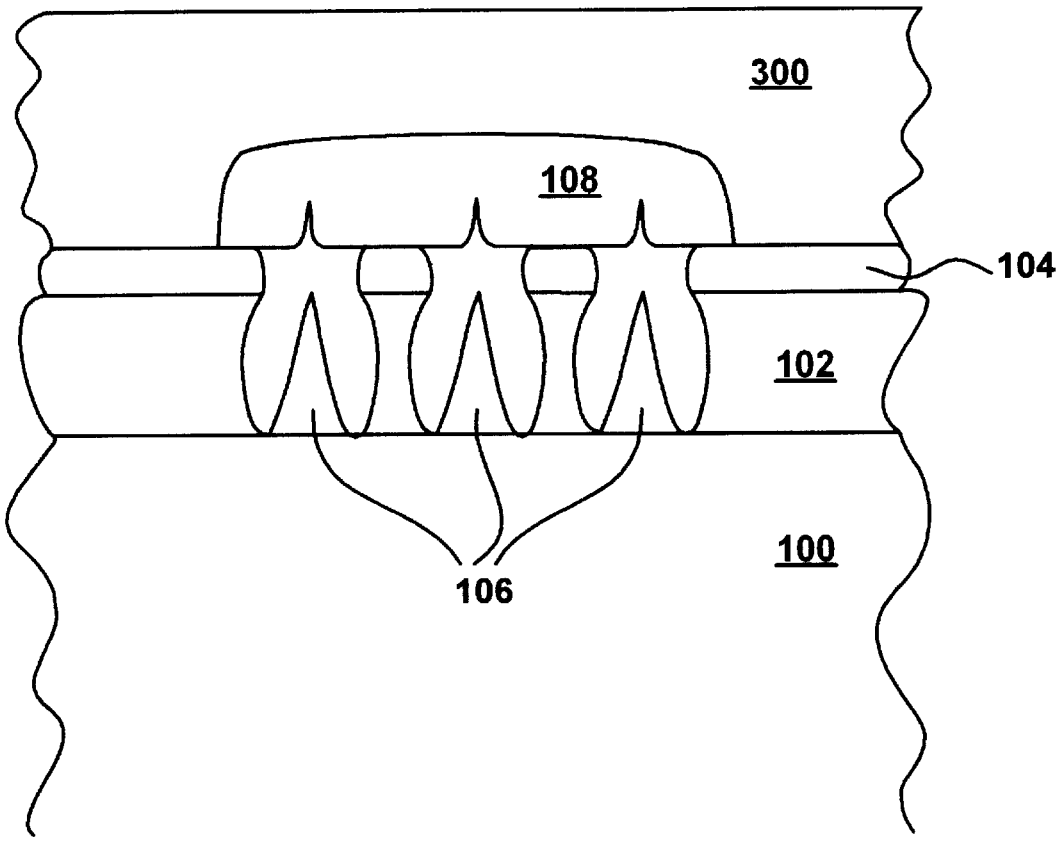
FIG. 3B shows a side sectional view of the structure of FIG. 3A having a layer of photo-imagable material disposed thereabove in accordance with one embodiment of the present claimed invention.

With reference now to FIG. 3B, in the present embodiment of the invention, a layer 300 of photo-imagable material is applied directly above the cathode portion of FIG. 3A. That is, in the present embodiment, it is not necessary to first deposit a layer of insulating material over the entire top surface of the cathode structure of FIG. 3A. In the present embodiment, layer 300 of photo-imagable material is comprised of photoresist such as, for example, AZ4620 Photoresist, available from Hoechst-Celanese of Somerville, N.J. It will be understood, however, that the present invention is well suited to the use of various other types and suppliers of photo-imagable material. Layer 300 of photoresist is deposited to a depth of approximately 40–100 microns in the present embodiment.

Figure 3C:
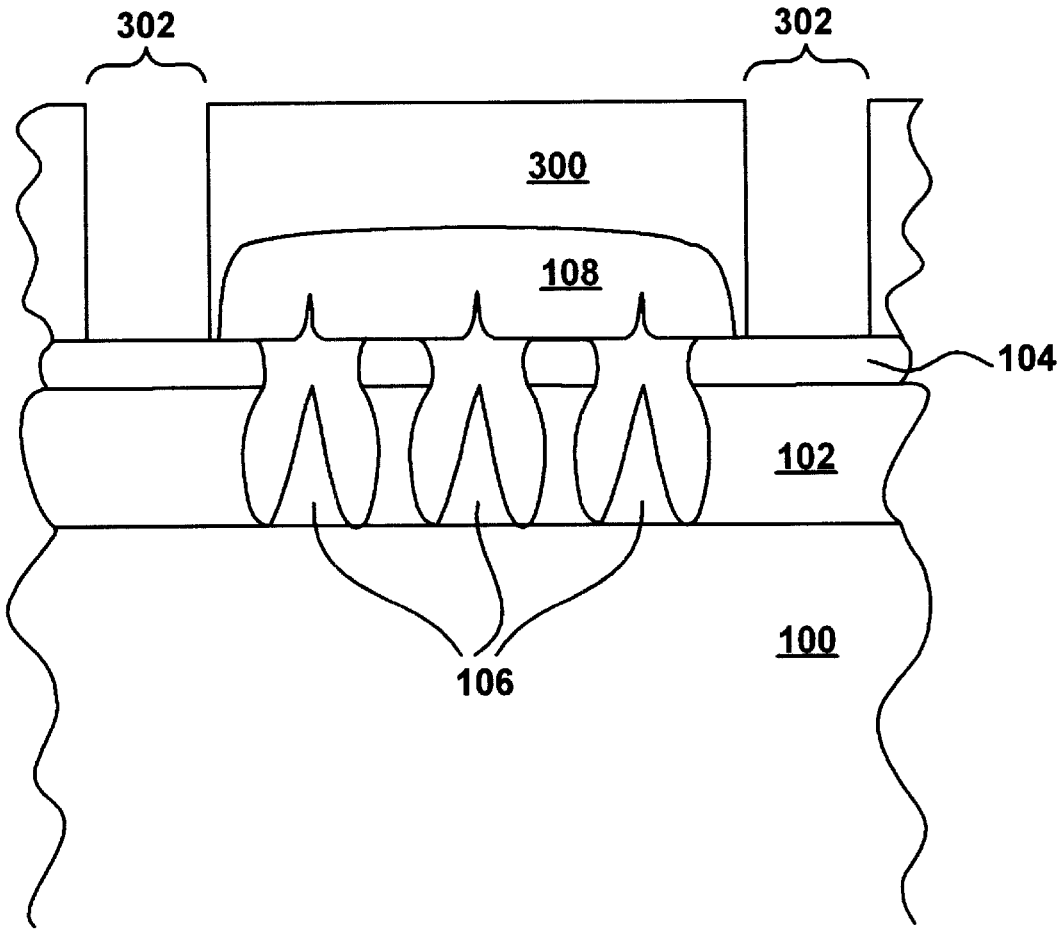
FIG. 3C shows a side sectional view of the structure of FIG. 3B having openings formed in the layer of photo-imagable material in accordance with one embodiment of the present claimed invention.

With reference next to FIG. 3C, after the deposition of layer of photo-imagable material 300, layer of photo-imagable material 300 is subjected to an exposure process. After the exposure process, the present embodiment removes portions of layer of photo-imagable material 300, such that openings, typically shown as 302 in the side sectional view of FIG. 3C, are formed in layer of photo-imagable material 300. In the present embodiment, openings 302 form a template for the formation of a conductive focus waffle structure. That is, openings 302 are disposed m a grid pattern comprised of substantially orthogonally oriented rows and columns. Furthermore, although only two openings, 302, are shown in FIG. 3C for purposes of clarity, it will be understood that numerous rows and columns of openings will be formed into layer of photo-imagable material 300.

Referring again to FIG. 2, a top plan view of the embodiment of FIG. 1D is shown in which openings 114 are formed into layer of photo-imagable material 112. The present invention forms similar openings in layer of photo-imagable material 300. However, in the present embodiment, openings 202 extend to conductive gate electrode layer 104. In the embodiment of FIGS. 1A–1H, openings 114 extend to layer of insulating material 110. In the embodiment of FIGS. 3A–3G, the openings 302 are disposed in the locations where a conductive focus waffle structure is to be formed in accordance with the present invention.

Figure 3D:
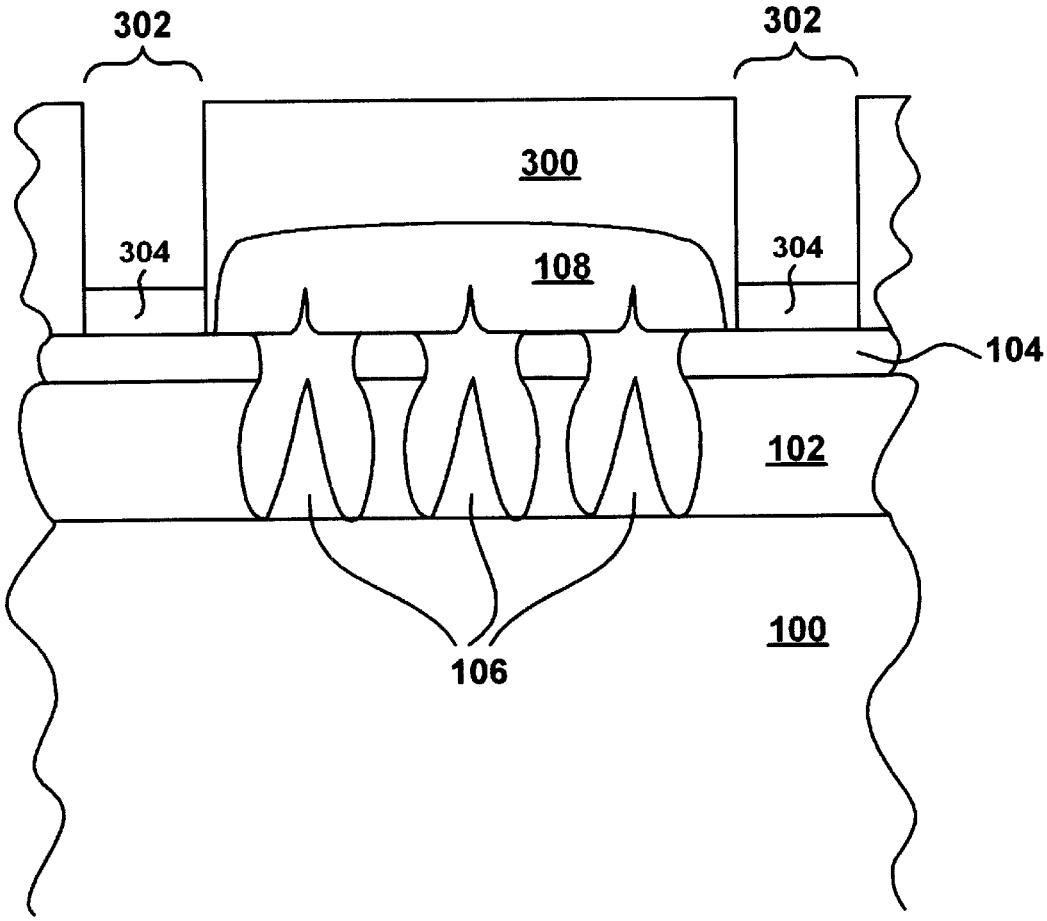
FIG. 3D shows a side sectional view of the structure of FIG. 3C having dielectric material disposed in the openings in accordance with one embodiment of the present claimed invention.

Referring now to FIG. 3D, in one embodiment of the present invention a layer of insulating material 304 (e.g. a layer of dielectric material) is applied into openings 302 in photo-imagable material 300. In the present embodiment, the layer of insulating material 304 is, for example, spin-on-glass (SOG). The present invention is, however, well suited to applying various other types of insulating material into openings 302 in photo-imagable material 300. In this embodiment, layer of insulating material 304 is deposited to a depth of approximately 5–50 microns. The present embodiment is well suited to applying insulating material over the entire surface of photo-imagable material such that some of the insulating material is deposited into openings 302. The excess insulating material can then be removed (e.g. by squeegeeing or mechanical polishing) or can be left in place above layer of photo-imagable material 300.

Figure 3E:
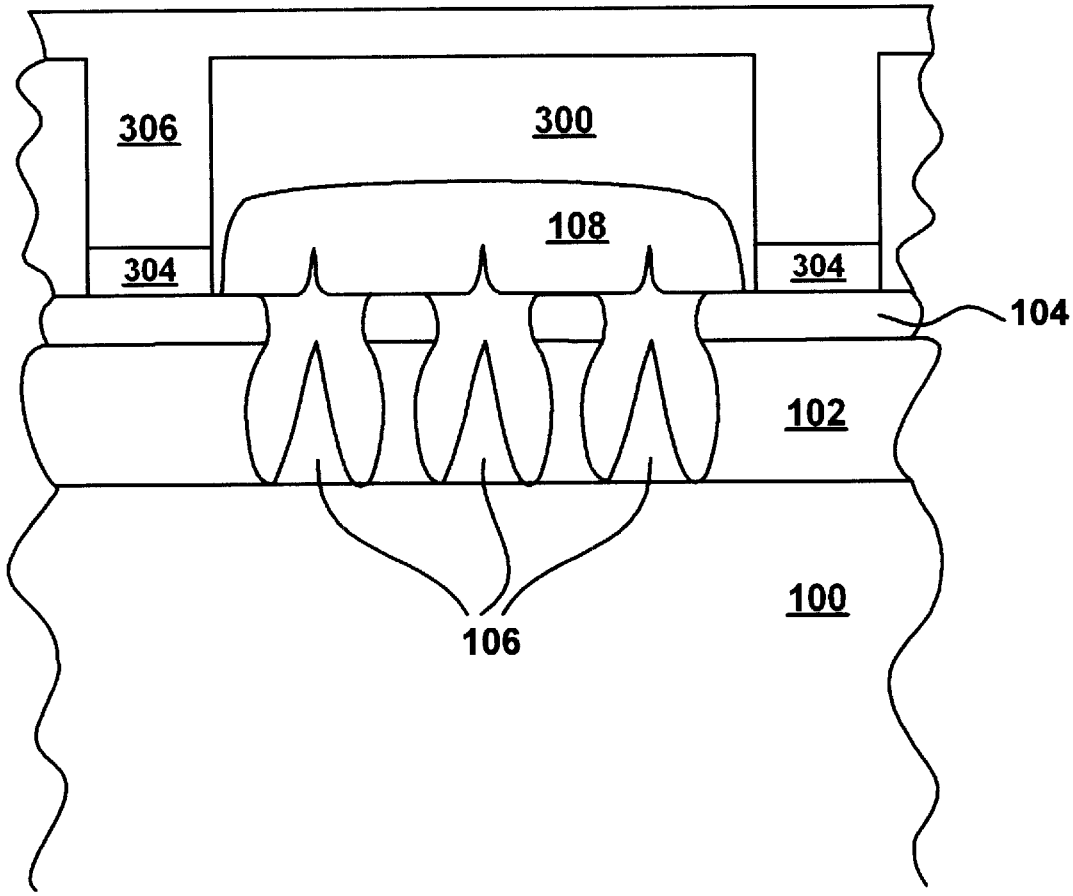
FIG. 3E shows a side sectional view of the structure of FIG. 3D having a conductive layer disposed over the layer of photo-imagable material and into the openings formed therein in accordance with one embodiment of the present claimed invention.

Referring now to FIG. 3E, after the formation of openings 302 and the deposition of insulating material 304, the present embodiment applies a layer of conductive material 306 over layer of photo-imagable material 300 and into openings 302 formed therein. As shown in FIG. 3E, layer of conductive material 302 is electrically insulated from gate electrode layer 104 by layer of insulating material 304 previously deposited into openings 302 in layer of photo-imagable material 300. In the present embodiment, layer of conductive material 306 is comprised, for example, of a CB800A DAG made by Acheson Colloids of Port Huron, Mich. In another embodiment, layer of conductive material 306 is comprised of a different graphite-based conductive material. In still another embodiment, the layer of graphite-based conductive material is applied as a semidry spray to reduce shrinkage of layer of conductive material 306. In such an embodiment, the present invention allows for improved control over the final depth of layer of conductive material 306 Although such deposition methods are recited above, it will be understood that the present invention is also well suited to using various other deposition methods to deposit various other conductive materials over layer of photo-imagable material 300 and into openings 302 formed in layer of photo-imagable material 300.

Figure 3F:
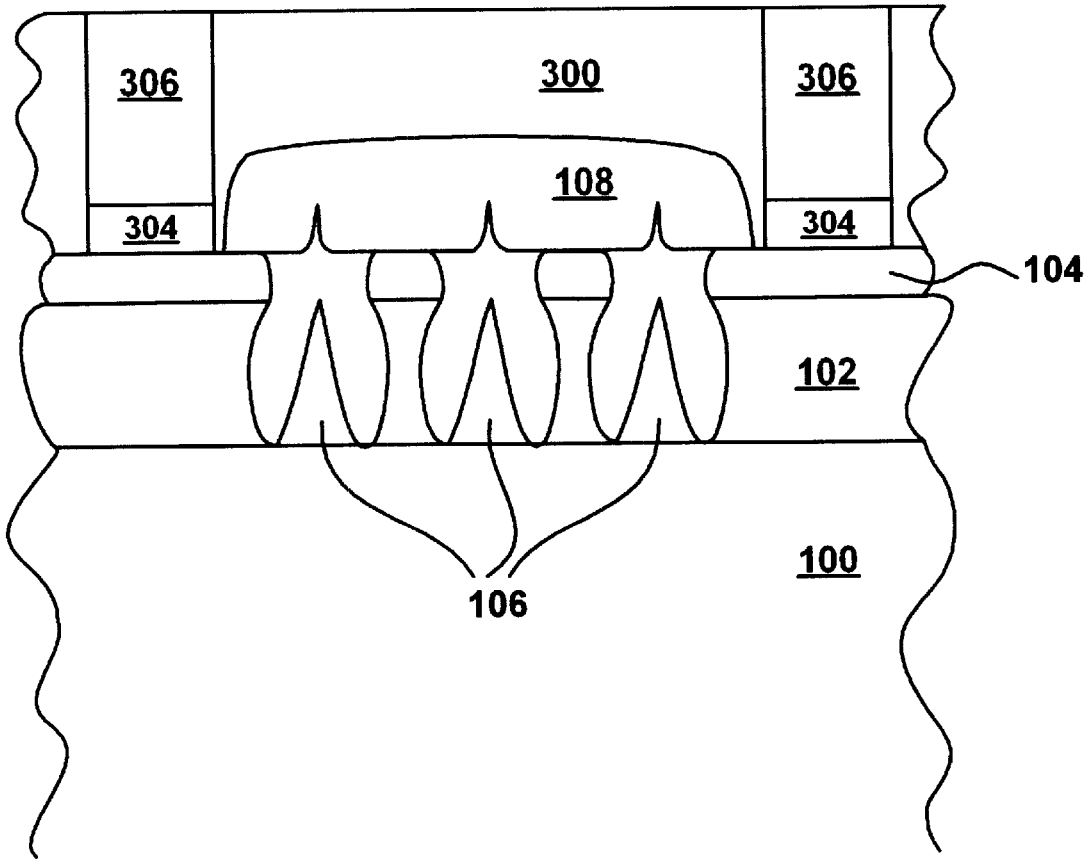
FIG. 3F shows a side sectional view of the structure of FIG. 3E having excess portions of conductive layer removed therefrom in accordance with one embodiment of the present claimed invention.

With next to FIG. 3F, in one embodiment of the present invention, excess conductive material disposed on top of and/or into openings 302 in layer of photo-imagable material 300 is removed by wiping off (e.g. "squeegeeing" and the like) the conductive material from the top surface of layer of photo-imagable material 300. In so doing, the present embodiment insures that layer of conductive material 306 is at a desired depth within openings 302 in layer of photo-imagable material 300. After the removal of excess conductive material, layer of conductive material 306 is hardened. In the present embodiment, layer of conductive material 306 is baked at approximately 80–90 degrees Celsius for approximately 4–5 minutes. In another embodiment, excess conductive material disposed on top of and/or in openings 302 in layer of photo-imagable material 300 is removed by mechanically polishing off the excess amounts of the conductive material after the hardening process. Again, such an approach insures that the conductive material is deposited to a desired depth within openings 302 in layer of photo-imagable material 300.

Figure 3G:
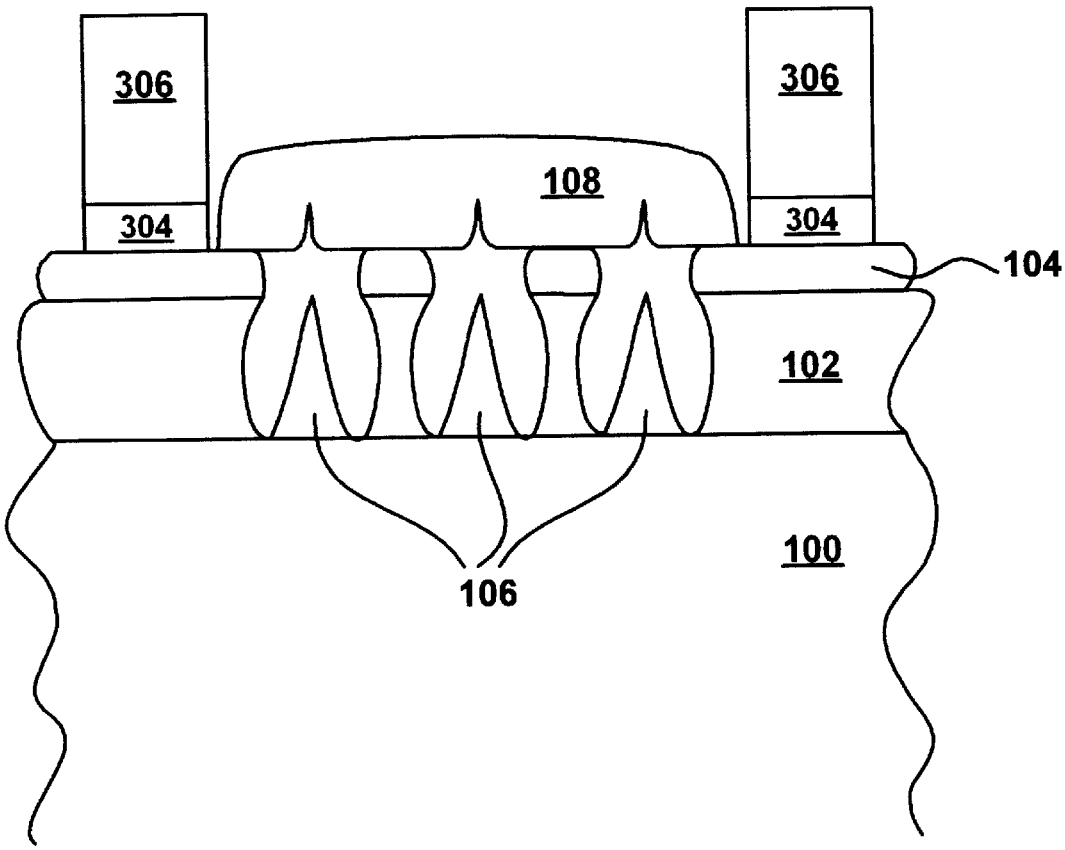
FIG. 3G shows a side sectional view of the structure of FIG. 3F having remaining portions of photo-imagable layer of material removed therefrom in accordance with one embodiment of the present claimed invention.

Referring now to FIG. 3G, after layer of conductive material 306 is hardened, the present invention removes remaining portions of layer of photo-imagable material 300. In the present embodiment, a technical grade acetone is applied to layer of photo-imagable material 300 to facilitate the removal process. The present invention is well suited to removing photo-imagable material using numerous other solvents such as 400T photoresist stripper of available from Hoechst-Celanese of Somerville, N.J., NMP stripper and the like. After the removal of the remaining portions of layer of photo-imagable material 300, rows and columns remain disposed above the cathode structure. As a result, the present embodiment provides a complete conductive focus waffle structure which is electrically insulated from gate layer 104 by portions of layer of insulating material 304. Moreover, the conductive focus waffle structure of the present embodiment includes a lower dielectric portion (comprised of a portion of layer of insulating material 304) and an upper conductive portion (comprised of conductive material disposed in openings 302 of photo-imagable layer 300 of FIGS. 3B–3F). Hence, the present embodiment forms a conductive focus waffle structure wherein the conductive focus waffle structure; which is electrically insulated from the underlying conductive gate electrode layer; wherein the conductive focus waffle structure is not formed of expensive and undesirable polyimide; and wherein the conductive focus waffle structure does not require a laborious and complex angled evaporation process step.

In the present embodiment, the substantially orthogonally oriented rows and columns of the conductive focus waffle structure are formed having a height of approximately 40–100 microns. Also, the substantially orthogonally oriented rows and columns define openings therebetween, wherein the openings having sufficient size to allow electrons emitted from field emitters 106 to pass therethrough. It will be understood that by applying a potential to the present conductive focus waffle structure, electrons emitted from field emitters 106 are directed towards respective sub-pixel regions.

Figure 4A:
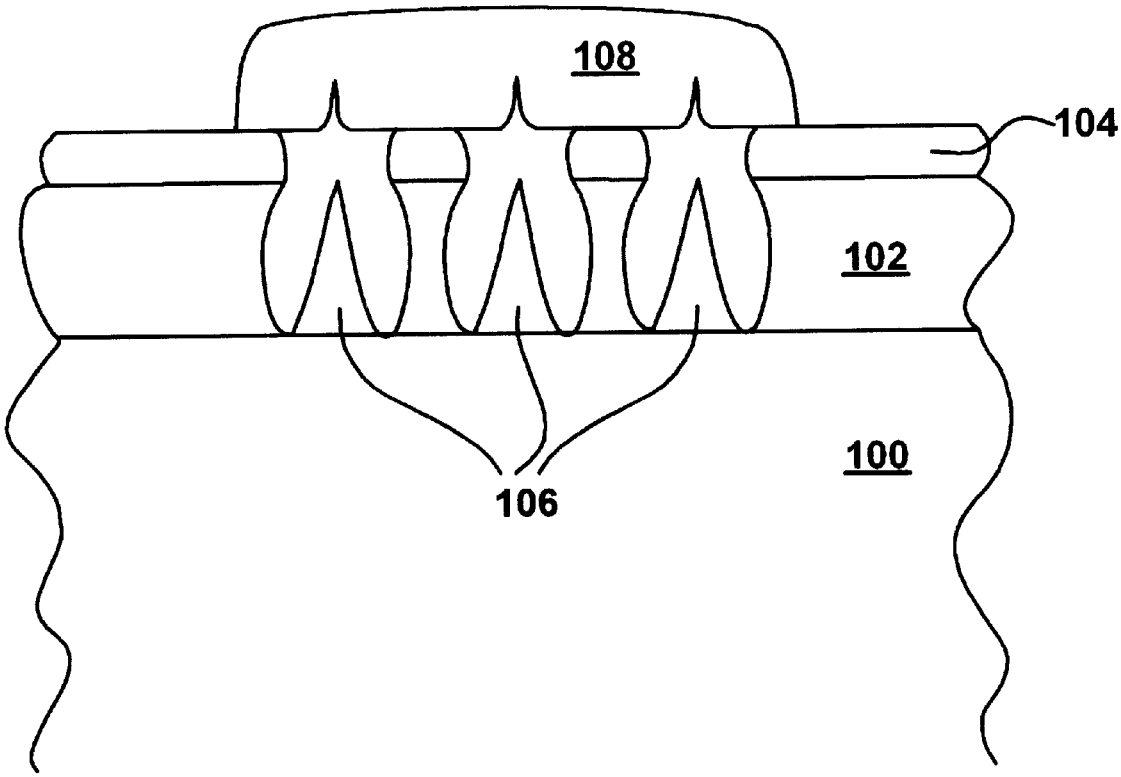
FIG. 4A shows a side sectional view depicting one starting point in a conductive focus waffle formation method in accordance with one embodiment of the present claimed invention.

With reference now to FIG. 4A, a side sectional view depicting a starting point in the conductive focus waffle formation method of one embodiment of the present claimed invention is shown. The structure of FIG. 4A is similar to or identical to the structure of FIG. 1A. Furthermore, it will be understood that for purposes of clarity, certain features well known in the art will not be depicted in the following figures or discussed in detail in the following description. In the embodiment of FIG. 4A, part of a cathode portion of a field emission display is shown. Specifically, in FIG. 4A, a substrate 100 has a row electrode (not shown) disposed thereon. The present invention is also well suited to various other configurations in which, for example, the row electrode has a resistive layer (not shown) disposed thereover. An inter-metal dielectric layer 102, comprised, for example, of silicon dioxide, is disposed above the row electrode. A conductive gate electrode layer 104 resides above inter-metal dielectric layer 102. Field emitter structures, typically shown as 106, are formed within respective cavities in inter-metal dielectric layer 102. Additionally, a closure layer 108 covers the cavities in inter-metal dielectric layer 102 and protects field emitters 106 during subsequent processing steps.

Figure 4B:
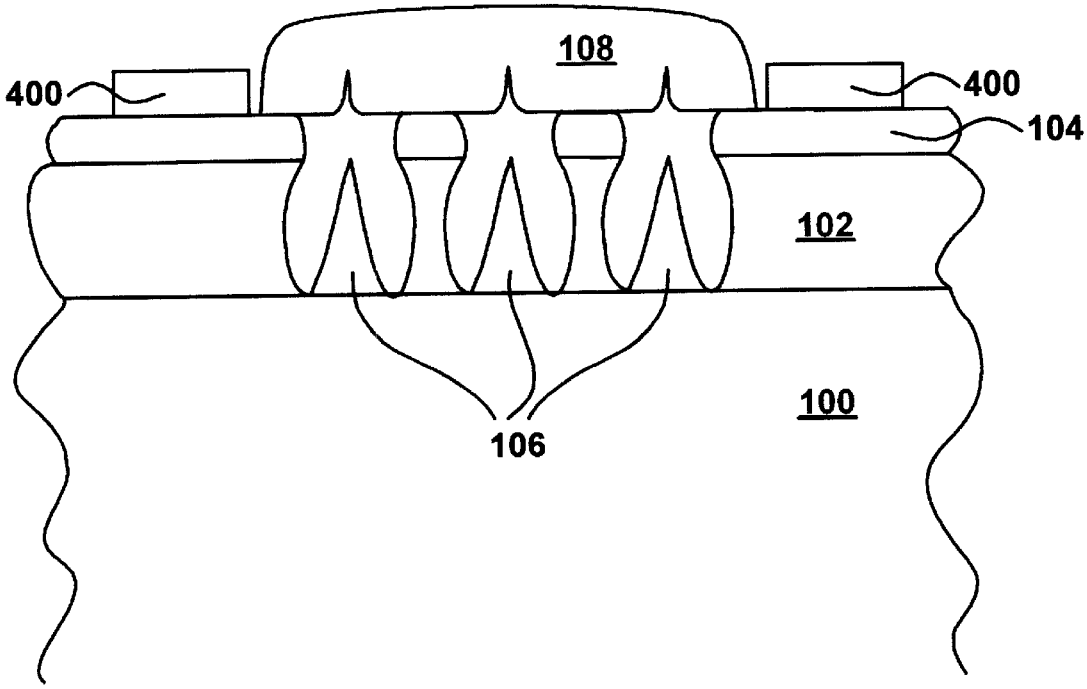
FIG. 4B shows a side sectional view of the structure of FIG. 4A having a layer of insulating material disposed thereabove in accordance with one embodiment of the present claimed invention.

Referring now to FIG. 4B, the present embodiment deposits an insulating layer of material 400 above the cathode structure. In the embodiment of FIG. 4A, insulating layer of material 400 is deposited using a screen-printing type of deposition process. That is, insulating material is repeatedly applied in the desired locations above the cathode structure until insulating layer of material 400 is at a desired depth. In the present embodiment, layer of insulating material is comprised, for example, of silicon dioxide, SOG, and the like.

Figure 4C:
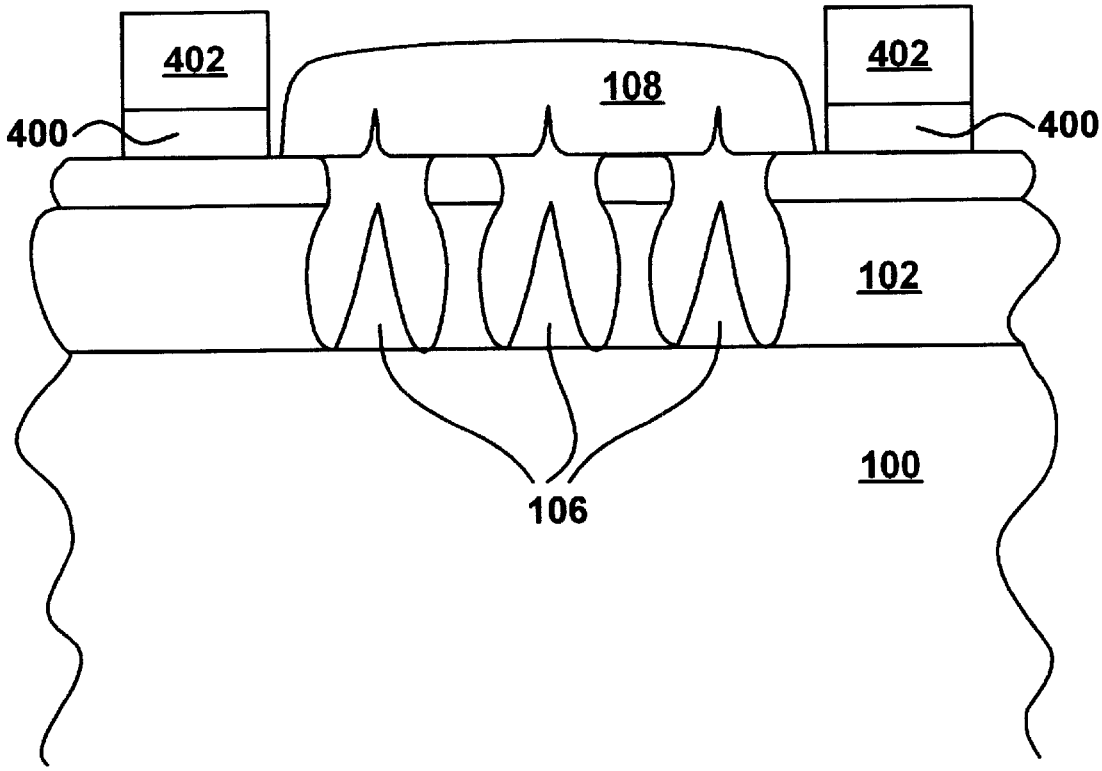
FIG. 4C shows a side sectional view of the structure of FIG. 4B having a conductive layer disposed over the layer of insulating material in accordance with one embodiment of the present claimed invention.

With reference next to FIG. 4C, the present embodiment then applies a layer of conductive material 402 over layer of insulating material 400. In this embodiment, layer of conductive material 402 is applied using a screen-printing type process. In so doing, the present invention incrementally forms orthogonally oriented rows and columns of a conductive focus waffle structure having a dielectric bottom portion and a conductive upper portion. Conductive layer 402 of the present embodiment is comprised of a conductive material such as, for example, CB800A DAG made by Acheson Colloids of Port Huron, Mich., another graphite-based conductive material, and the like.

Figure 4D:
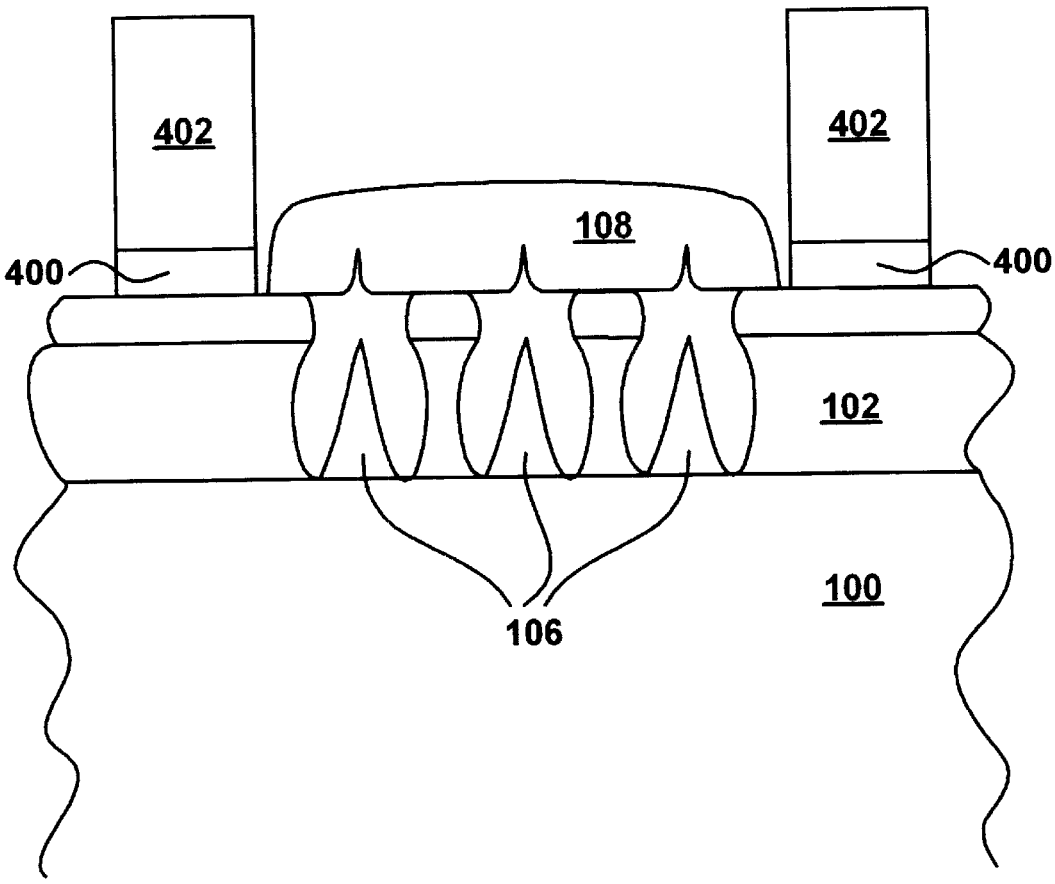
FIG. 4D shows a side sectional view of the structure of FIG. 4C having a thicker conductive layer disposed over the layer of insulating material in accordance with one embodiment of the present claimed invention.

Referring now to FIG. 4D, the present embodiment repeatedly applies layers of the conductive material over the surface of the cathode structure until the conductive focus waffle structure is completely formed. In the present embodiment, the conductive material is repeatedly applied until the conductive focus waffle structure has a height of approximately 40–100 microns. Thus, the present embodiment provides a method for the formation of a conductive focus waffle structure wherein the method does not require the deposition and patterning of a layer of photo-imagable material. In the present embodiment, the substantially orthogonally oriented rows and columns define openings therebetween, wherein the openings having sufficient size to allow electrons emitted from field emitters 106 to pass therethrough. It will be understood that by applying a potential to the present conductive focus waffle structure, electrons emitted from field emitters 106 are directed towards respective sub-pixel regions.

Figure 5A:
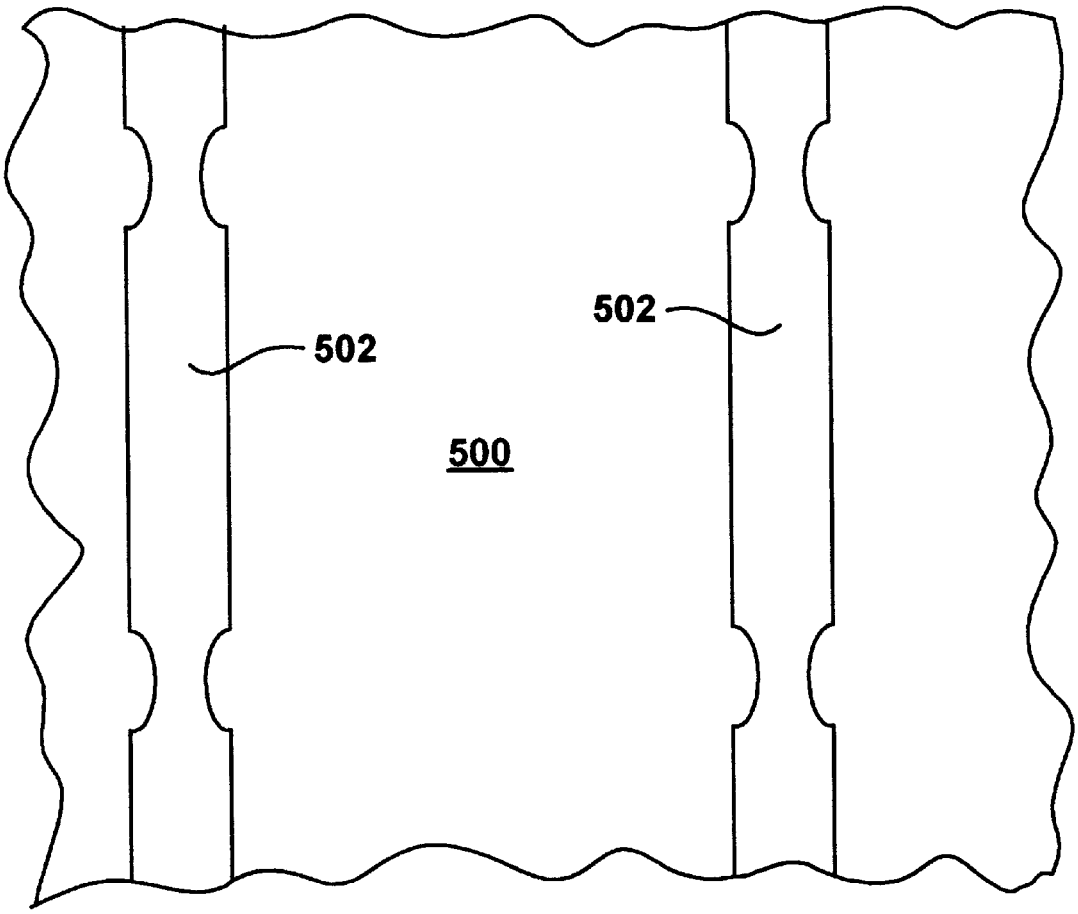
FIG. 5A is a top plan view of a structure formed in accordance with one embodiment of the present claimed invention.
Figure 6A:
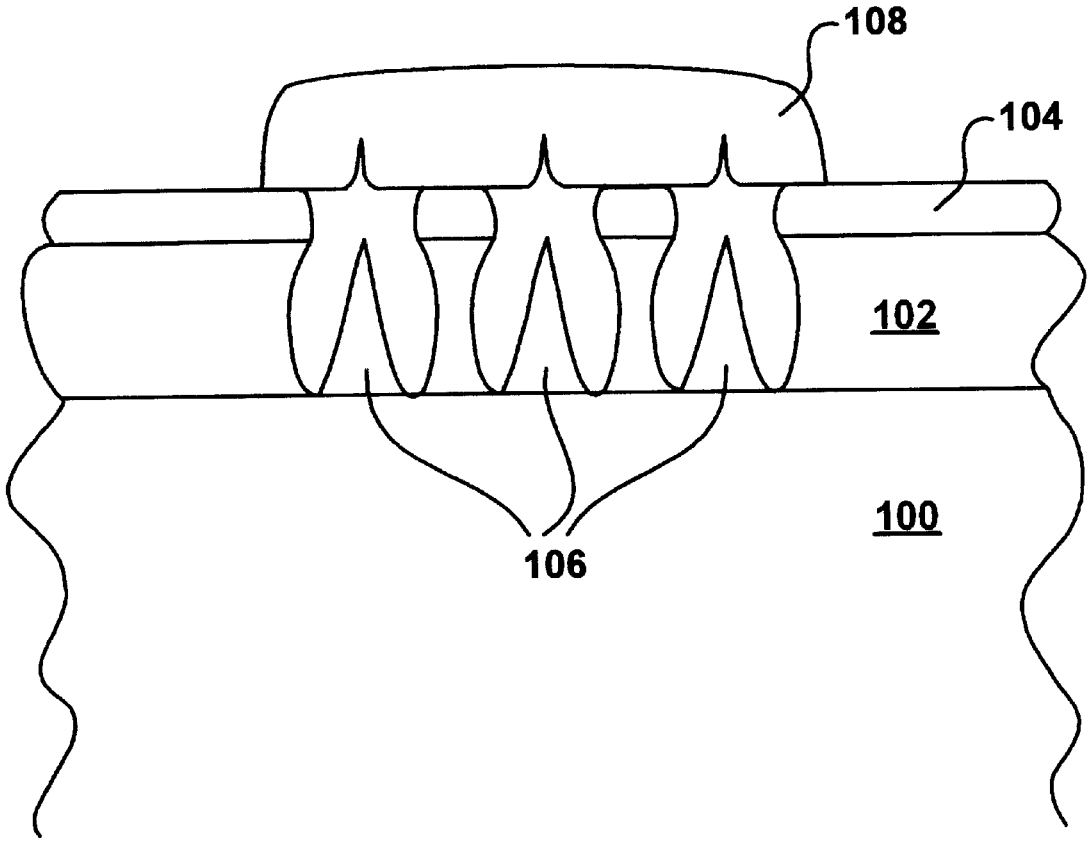
FIG. 6A shows a side sectional view depicting one starting point in a conductive focus waffle formation method in accordance with one embodiment of the present claimed invention.

With reference now to FIG. 5A, a top plan view of a structure formed in accordance with another embodiment of the present invention is shown. In the embodiment of FIG. 5A, a two step-approach is used to form the conductive focus waffle structure. More specifically, in embodiments such as the embodiments of FIGS. 1A–1H, and 3A–3G, openings shown as 502 in FIG. 6A are formed in layer of photo-imagable material 500 using process steps as recited in conjunction with FIGS. 1B and 1C. That is, openings 502 extend through layer of photo-imagable material 500 to the underlying layer of insulating material. In conjunction with the embodiment of FIGS. 3A–3G, after the formation of openings 502 in photo-imagable layer of material 500, insulating material is deposited into openings 502.

With reference still to the embodiment of FIG. 5A, unlike openings 114 of FIG. 2 which comprise both row and column patterns of the conductive focus waffle structure, openings 502 of FIG. 5A, comprise only patterns for the formation of the rows of the conductive focus waffle structure. Thus, in such an embodiment, after the completion of process steps as are recited in conjunction with FIGS. 1E–1H, or, alternatively, process steps recited in conjunction with steps 3E–3G conductive row portions of a conductive focus waffle structure are formed. Hence, unlike the above-described embodiments in which the row and column portions of the conductive focus waffle structure are formed concurrently, the embodiment depicted by FIGS. 5A–5D forms the row and column portions of the conductive focus waffle structure sequentially.

Figure 5B:
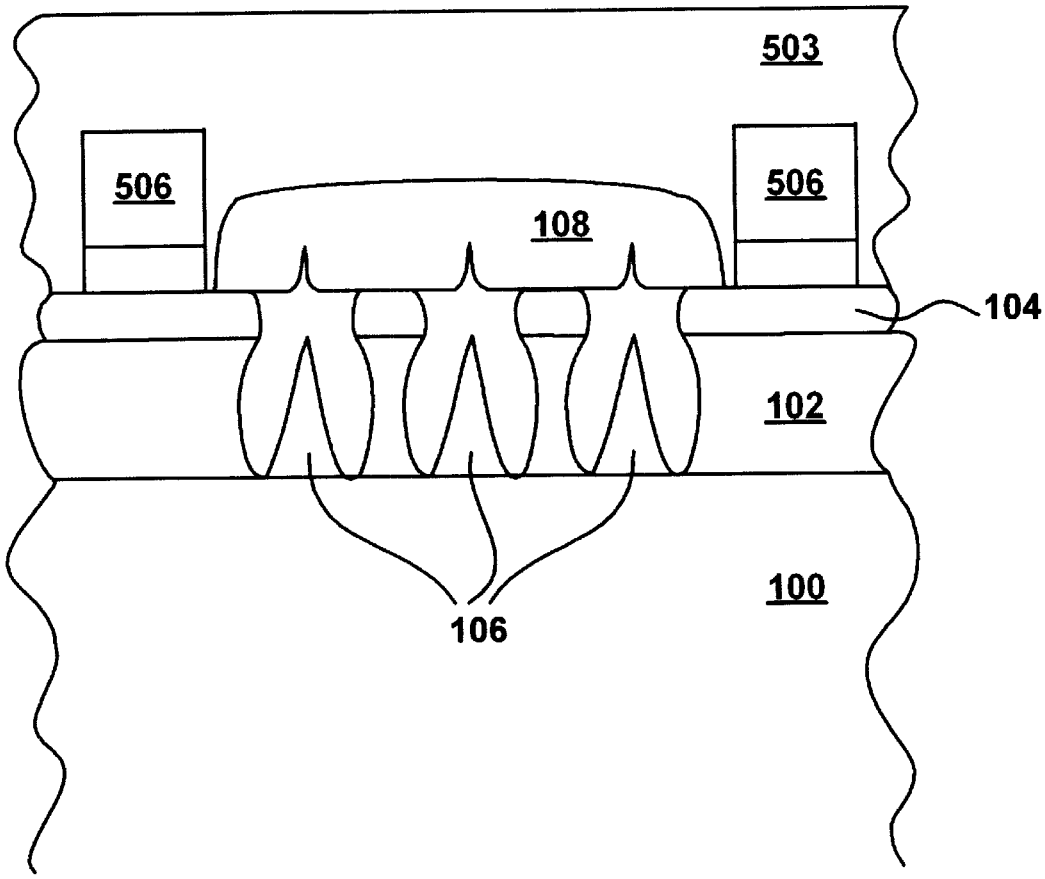
FIG. 5B shows a side sectional view of the structure of FIG. 5A having a second layer of photo-imagable layer of material disposed thereon in accordance with one embodiment of the present claimed invention.
Figure 5C:
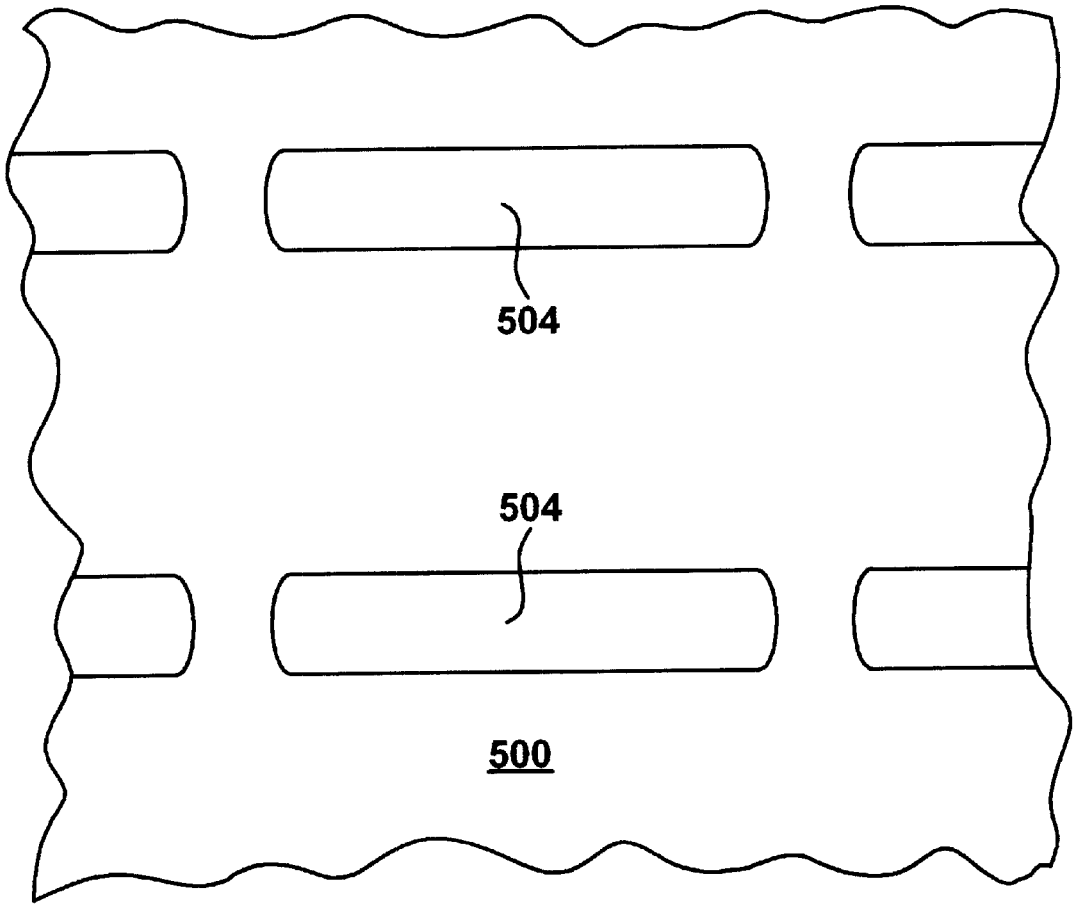
FIG. 5C is a top plan view of the structure of FIG. 5B with additional openings formed therein in accordance with one embodiment of the present claimed invention.

Referring now to FIG. 5B, after the formation of the row portion of the conductive focus waffle structure, the present embodiment applies a second layer of photo-imagable material 503 above the cathode portion and over the previously formed row portion of the conductive focus waffle structure. In embodiments such as the embodiments of FIGS. 1A–1H, and 3A–3G, openings shown as 504 in FIG. 5C are formed in layer of photo-imagable material 500 using process steps as recited in conjunction with FIGS. 1B and 1C. That is, openings 504 extend through layer of photo-imagable material 503 to the underlying layer of insulating material. In conjunction with the embodiment of FIGS. 3A–3G, after the formation of openings 504 in photo-imagable layer of material 503, insulating material is deposited into openings 503.

With reference still to the embodiment of FIG. 5C, similar to openings 502 of FIG. 5A, openings 504 of FIG. 5C, comprise only patterns for the formation of the columns of the conductive focus waffle structure. Thus, in such an embodiment, after the completion of process steps as are recited in conjunction with FIGS. 1E–1H, or, alternatively, process steps recited in conjunction with steps 3E–3G conductive column portions of a conductive focus waffle structure are formed.

Figure 5D:
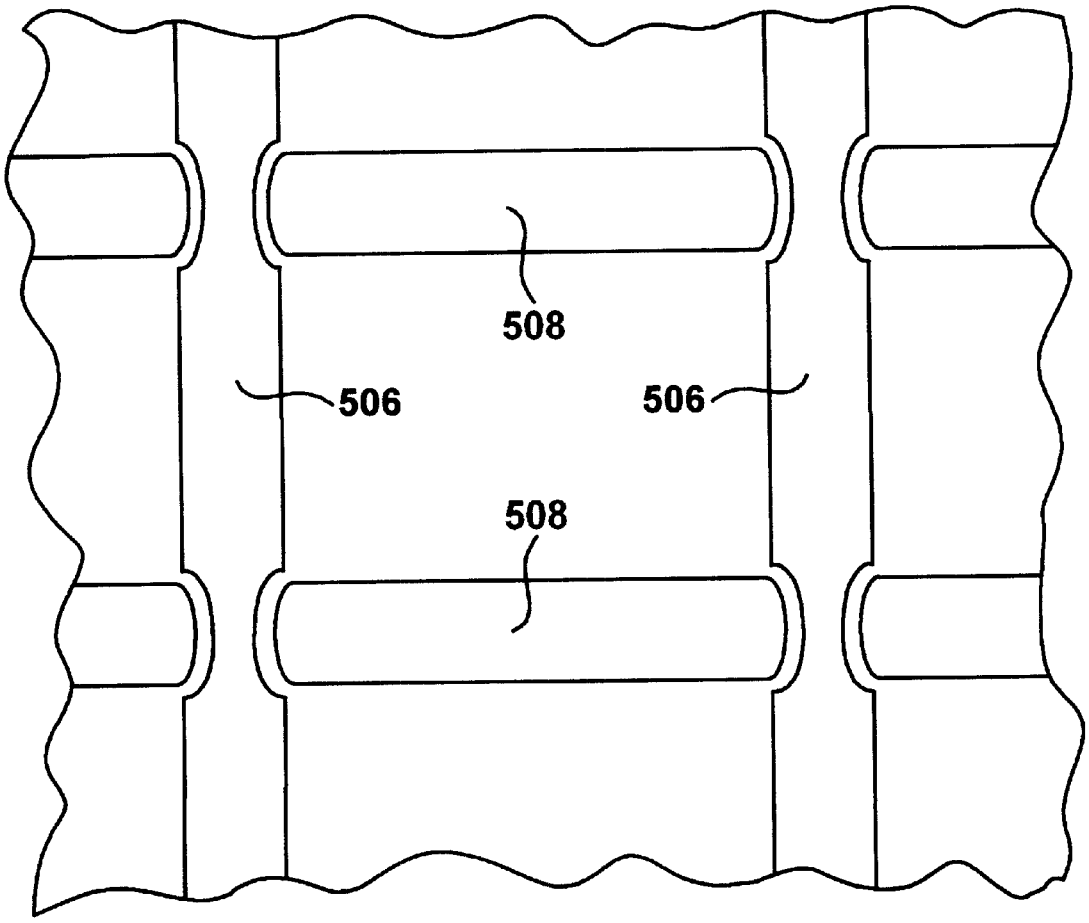
FIG. 5D is a top plan view of a conductive focus waffle structure formed in accordance with one embodiment of the present claimed invention.

FIG. 5D, is provides a top plan view of the conductive focus waffle structure of the present invention including conductive row portions 506 and conductive column portions 508. In this embodiment, conductive row portions 506 and conductive column portions 508 are electrically insulated from the underlying conductive gate electrode layer 104 by a layer of insulating material, hidden. Hence, the embodiment depicted by FIGS. 5A–5D forms row portions 506 and column portions 508 of the conductive focus waffle structure sequentially.

Additionally, in the present embodiment as shown in FIG. 5B, layer of photo-imagable material 503 is deposited to a thickness which is greater than the height of conductive row portions 506. Thus, in the present embodiment, column portions 508 of the conductive focus waffle structure are formed having a different height than row portions 506 of the conductive focus waffle structure. More specifically, in one embodiment, column portions 508 are formed having a height which is greater than the height of row portions 506 of the present conductive focus waffle structure. As a result, the present invention is well suited to having column portions 508 buttress a support structure disposed along row portions 506. Hence, the taller height of column portions 508 near the intersection with row portions 506 provides buttressing for support structures disposed along row portions 506. That is, a wall, rib, or another support structure commonly located on row portions 506 is stabilized or buttressed by taller proximately located column portions 508.

Although the above-described embodiment recites forming row portions 506 of the conductive focus waffle structure and then forming column portions 508 of the conductive focus waffle structure, the present invention is also well suited to forming columns portions 508 of the conductive focus waffle structure prior to forming the row portions 506 of the conductive focus waffle structure. Similarly, the present invention is also well suited to forming the conductive focus waffle structure such that the row portions 506 are taller than the column portions 508.

Also, although the embodiment of FIGS. 5A–5D is described in conjunction with the process steps illustrated in FIGS. 1A–1H, and FIGS. 3A–3G, the embodiment of FIGS. 5A–5D is also well suited for use in conjunction with the steps illustrated in FIGS. 4A–4D. That is, the present invention also includes an embodiment in which the process steps of FIGS. 4A–4D are used to sequentially form row portions and column portions of a conductive focus waffle structure.

With reference now to FIG. 6A, a side sectional view depicting a starting point in the conductive focus waffle formation method of one embodiment of the present claimed invention is shown. It will be understood that for purposes of clarity, certain features well known in the art will not be depicted in the following figures or discussed in detail in the following description. In the present embodiment, part of a cathode portion of a field emission display is shown. Specifically, in FIG. 6A, a substrate 100 has a row electrode (not shown) disposed thereon. The present invention is also well suited to various other configurations in which, for example, the row electrode has a resistive layer (not shown) disposed thereover. An inter-metal dielectric layer 102, comprised, for example, of silicon dioxide, is disposed above the row electrode. A conductive gate electrode layer 104 resides above inter-metal dielectric layer 102. Field emitter structures, typically shown as 106, are formed within respective cavities in inter-metal dielectric layer 102. Additionally, a closure layer 108 covers the cavities in inter-metal dielectric layer 102 and protects field emitters 106 during subsequent processing steps.

Figure 6B:
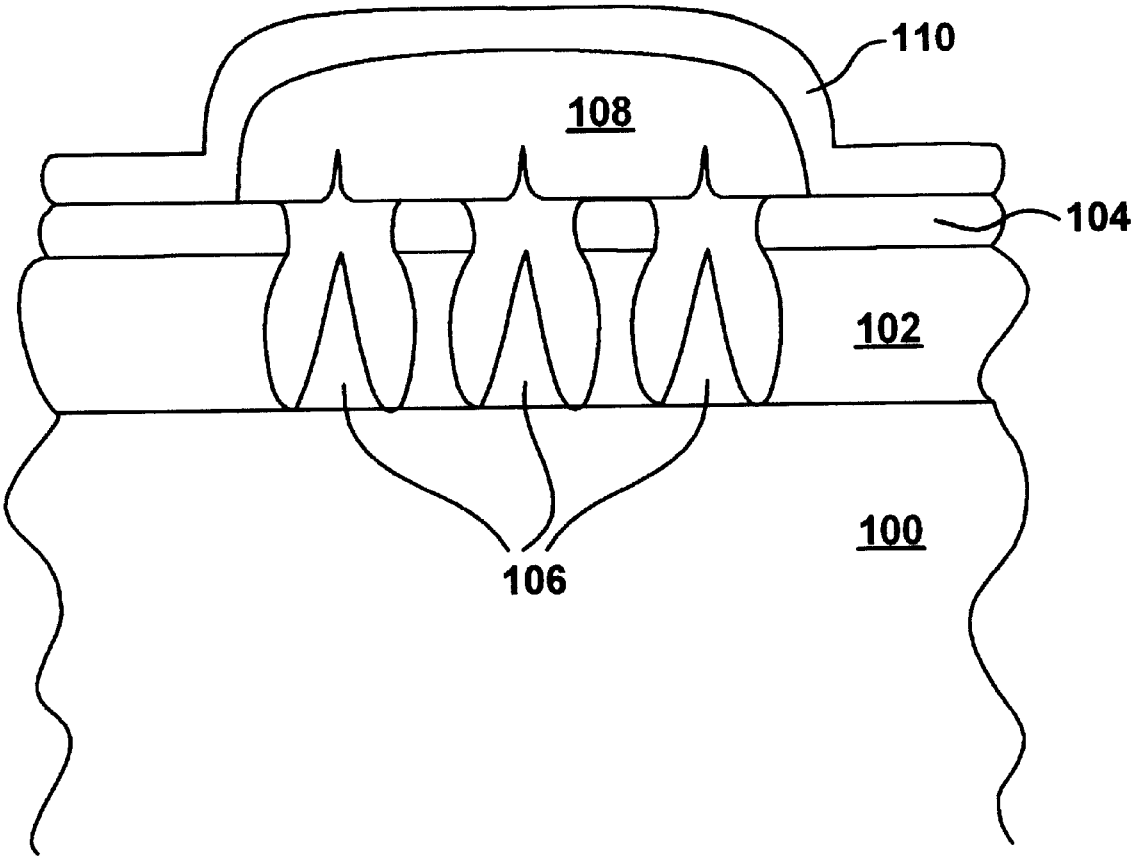
FIG. 6B shows a side sectional view of the structure of FIG. 6A having a layer of dielectric material disposed thereabove in accordance with one embodiment of the present claimed invention.

Referring now to FIG. 6B, in one embodiment of the present invention a layer of insulating material 110 (e.g. a layer of dielectric material) is applied above said cathode portion. In the present embodiment, the layer of insulating material 110 is, for example, spin-on-glass (SOG). The present invention is, however, well suited to applying various other types of insulating material above the cathode portion of FIG. 6A In this embodiment, layer of insulating material 110 is deposited to a depth of approximately 5–50 microns.

Figure 6C:
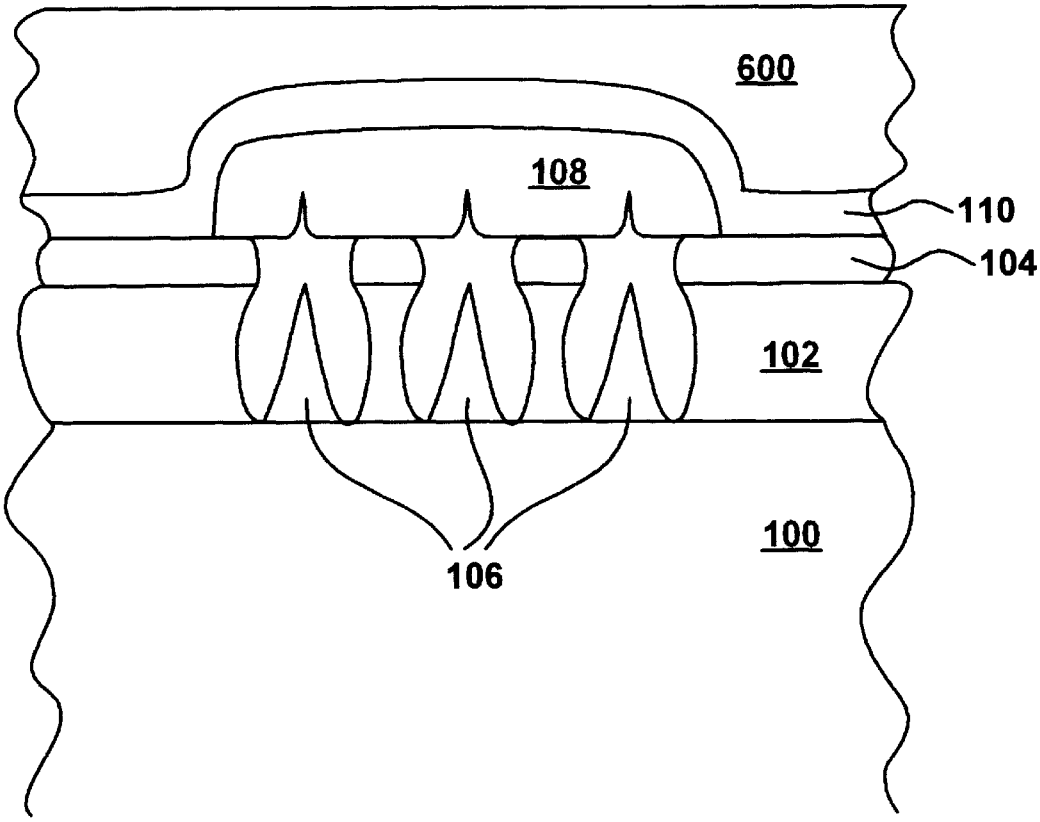
FIG. 6C shows a side sectional view of the structure of FIG. 6B having a first layer of photo-imagable material disposed thereabove in accordance with one embodiment of the present claimed invention.

With reference now to FIG. 6C, in the present embodiment of the invention, a layer 600 of photo-imagable material is applied above dielectric layer 110 of the cathode portion of FIG. 6B. In the present embodiment, layer 600 of photo-imagable material is comprised of photoresist such as, for example, AZ4620 Photoresist, available from Hoechst-Celanese of Somerville, N.J. It will be understood, however, that the present invention is well suited to the use of various other types and suppliers of photo-imagable material. Layer 600 of photoresist is deposited to a depth of approximately 20–50 microns in the present embodiment.

Figure 6D:
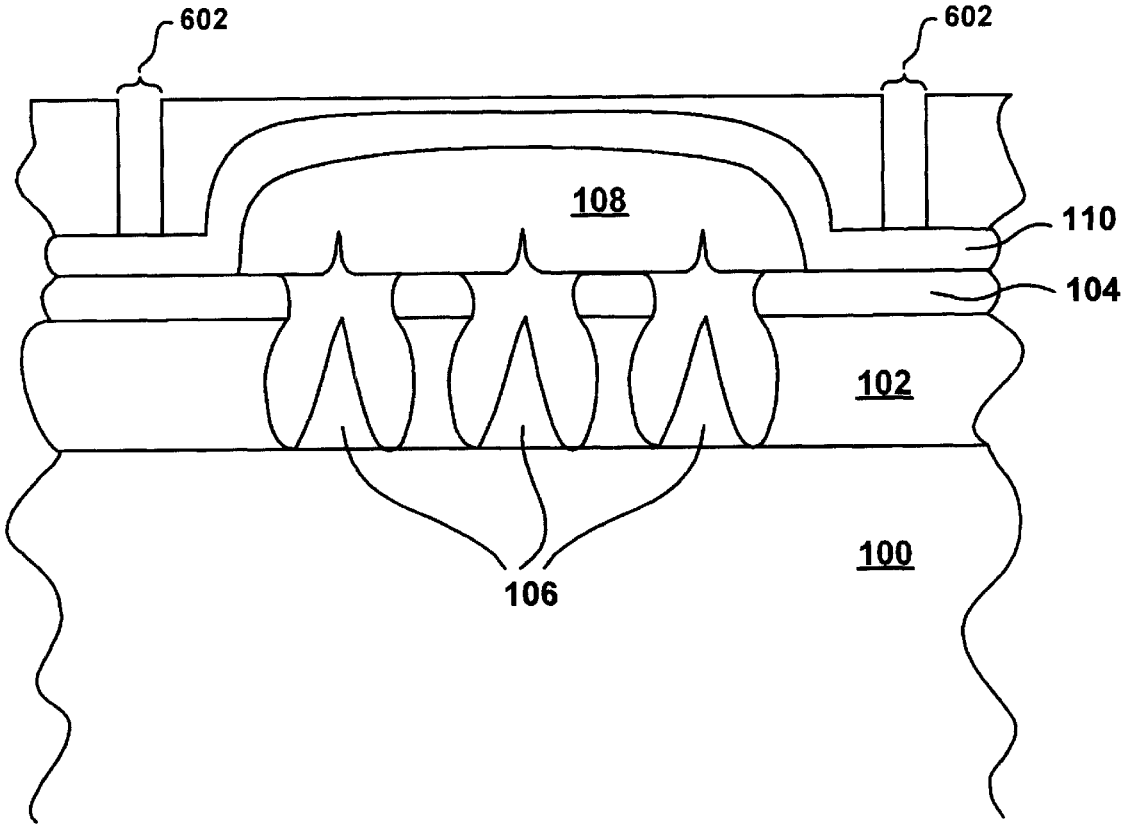
FIG. 6D shows a side sectional view of the structure of FIG. 6C having openings formed in the first layer of photo-imagable material in accordance with one embodiment of the present claimed invention.

With reference next to FIG. 6D, after the deposition of layer of photo-imagable material 600, layer of photo-imagable material 600 is subjected to a first exposure process. After the first exposure process, the present embodiment removes portions of layer of photo-imagable material 600, such that openings, typically shown as 602 in the side sectional view of FIG. 6D, are formed in layer of photo-imagable material 600. In the present embodiment, openings 602 form the first part of a template for the formation of a conductive focus waffle structure. That is, openings 602 are disposed in a grid pattern comprised of substantially orthogonally oriented rows and columns. Furthermore, although only two openings, 602, are shown in FIG. 6D for purposes of clarity, it will be understood that numerous rows and columns of openings will be formed into layer of photo-imagable material 600.

Figure 6E:
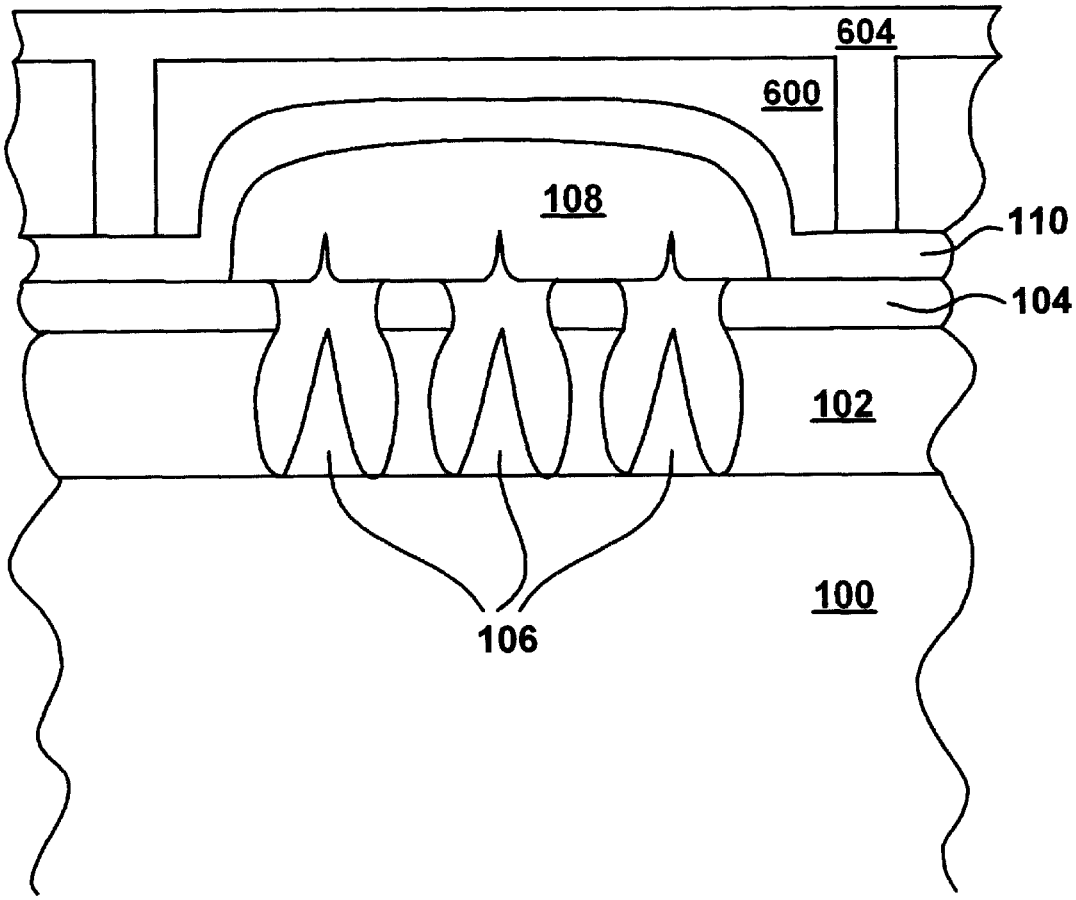
FIG. 6E shows a side sectional view of the structure of FIG. 6D having a first conductive layer disposed over the first layer of photo-imagable material and into the first openings formed therein in accordance with one embodiment of the present claimed invention.

Referring now to FIG. 6E, after the formation of openings 602 of FIG. 6C, the present embodiment applies a first layer of conductive material 604 over layer of photo-imagable material 600 and into openings 602 formed therein. As shown in FIG. 6E, first layer of conductive material 604 is electrically insulated from conductive gate electrode layer 104 by layer of insulating material 110. In the present embodiment, first layer of conductive material 604 is comprised, for example, of a CB800A DAG made by Acheson Colloids of Port Huron, Mich. In another embodiment, first layer of conductive material 604 is comprised of a different graphite-based conductive material. In still another embodiment, the layer of graphite-based conductive material is applied as a semi-dry spray to reduce shrinkage of first layer of conductive material 604. In such an embodiment, the present invention allows for improved control over the final depth of first layer of conductive material 604. Although such deposition methods are recited above, it will be understood that the present invention is also well suited to using various other deposition methods to deposit various other conductive materials over layer of photo-imagable material 600 and into openings 602 formed in layer of photo-imagable material 600.

Figure 6F:
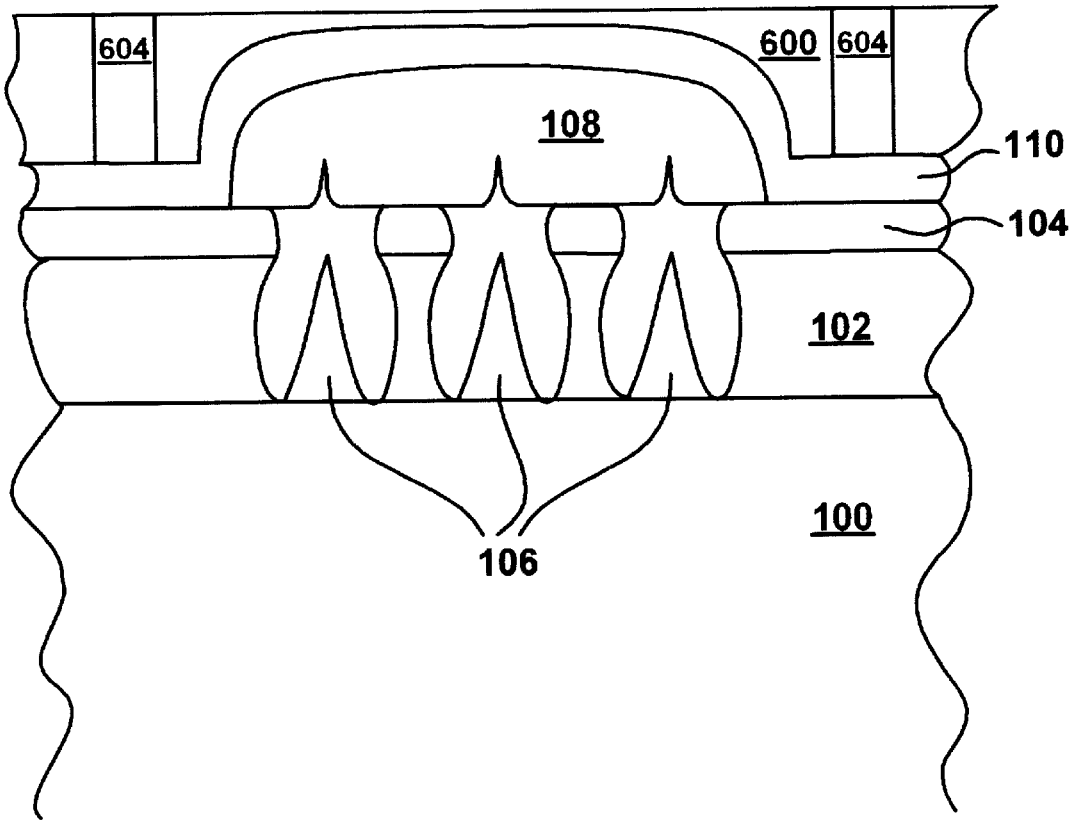
FIG. 6F shows a side sectional view of the structure of FIG. 6E having excess portions of the first conductive layer removed therefrom in accordance with one embodiment of the present claimed invention.

With next to FIG. 6F, in one embodiment of the present invention, excess conductive material disposed on top of and/or into openings 602 in layer of photo-imagable material 600 is removed by wiping off (e.g. "squeegeeing" and the like) the conductive material from the top surface of layer of photo-imagable material 600. In so doing, the present embodiment insures that first layer of conductive material 604 is at a desired depth within openings 602 in layer of photo-imagable material 600. After the removal of excess conductive material, first layer of conductive material 604 is hardened. In the present embodiment, first layer of conductive material 604 is baked at approximately 80–90 degrees Celsius for approximately 4–5 minutes. In another embodiment, excess conductive material disposed on top of and/or in openings 602 in layer of photo-imagable material 600 is removed by mechanically polishing off the excess amounts of the conductive material after the hardening process. Again, such an approach insures that the conductive material is deposited to a desired depth within openings 602 in layer of photo-imagable material 600.

Figure 6G:
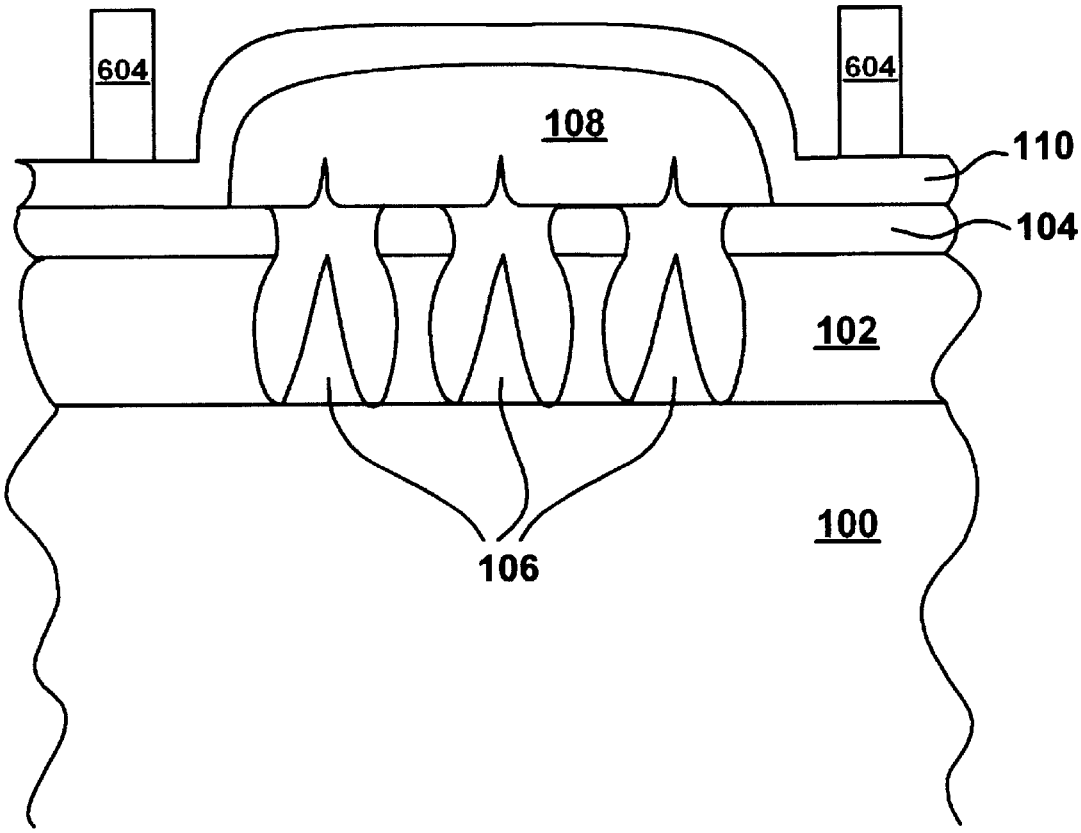
FIG. 6G shows a side sectional view of the structure of FIG. 6F having remaining portions of the first photo-imagable layer of material removed therefrom in accordance with one embodiment of the present claimed invention.

Referring now to FIG. 6G, after first layer of conductive material 604 is hardened, the present invention removes remaining portions of layer of photo-imagable material 600. In the present embodiment, a technical grade acetone is applied to layer of photo-imagable material 600 to facilitate the removal process. The present invention is well suited to removing photo-imagable material using numerous other solvents such as 400T photoresist stripper of available from Hoechst-Celanese of Somerville, N.J., NMP stripper and the like. After the removal of the remaining portions of layer of photo-imagable material 600, first portions of conductive rows and columns 604 remain disposed above layer of insulating material 110.

Figure 6H:
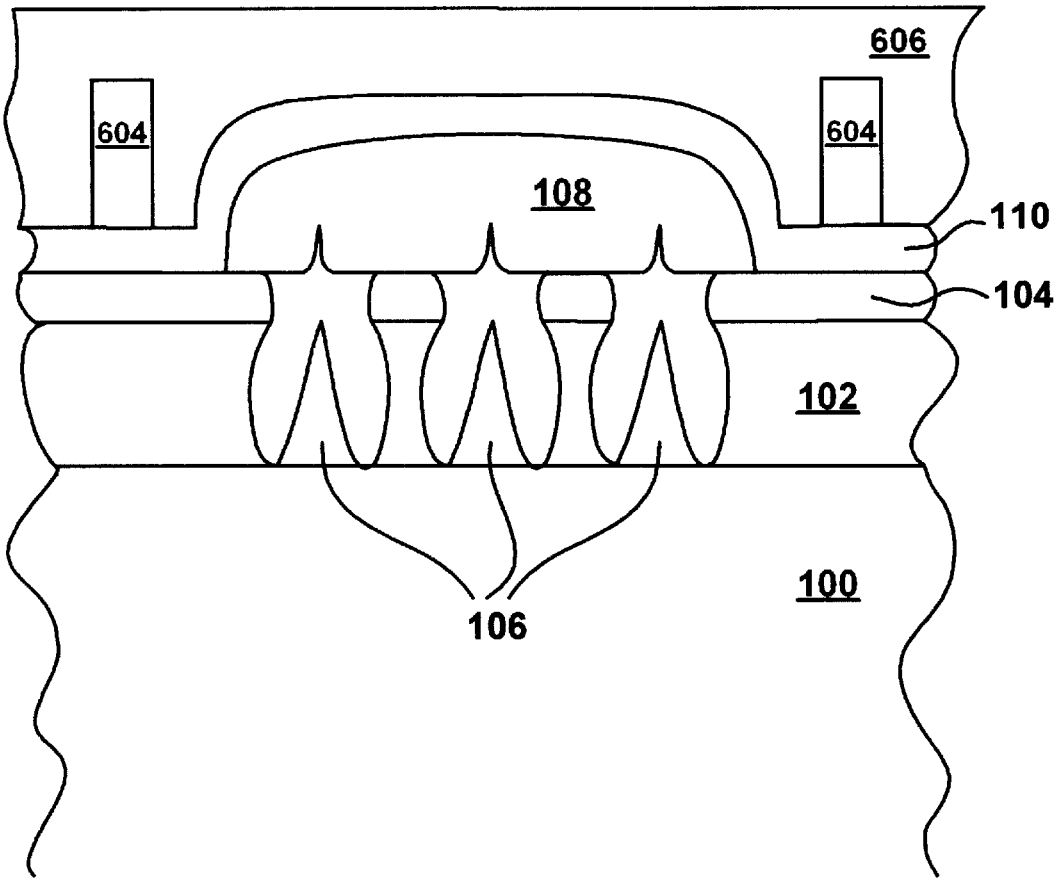
FIG. 6H shows a side sectional view of the structure of FIG. 6G having a second layer of photo-imagable material disposed thereabove in accordance with one embodiment of the present claimed invention.
Figure 6I:
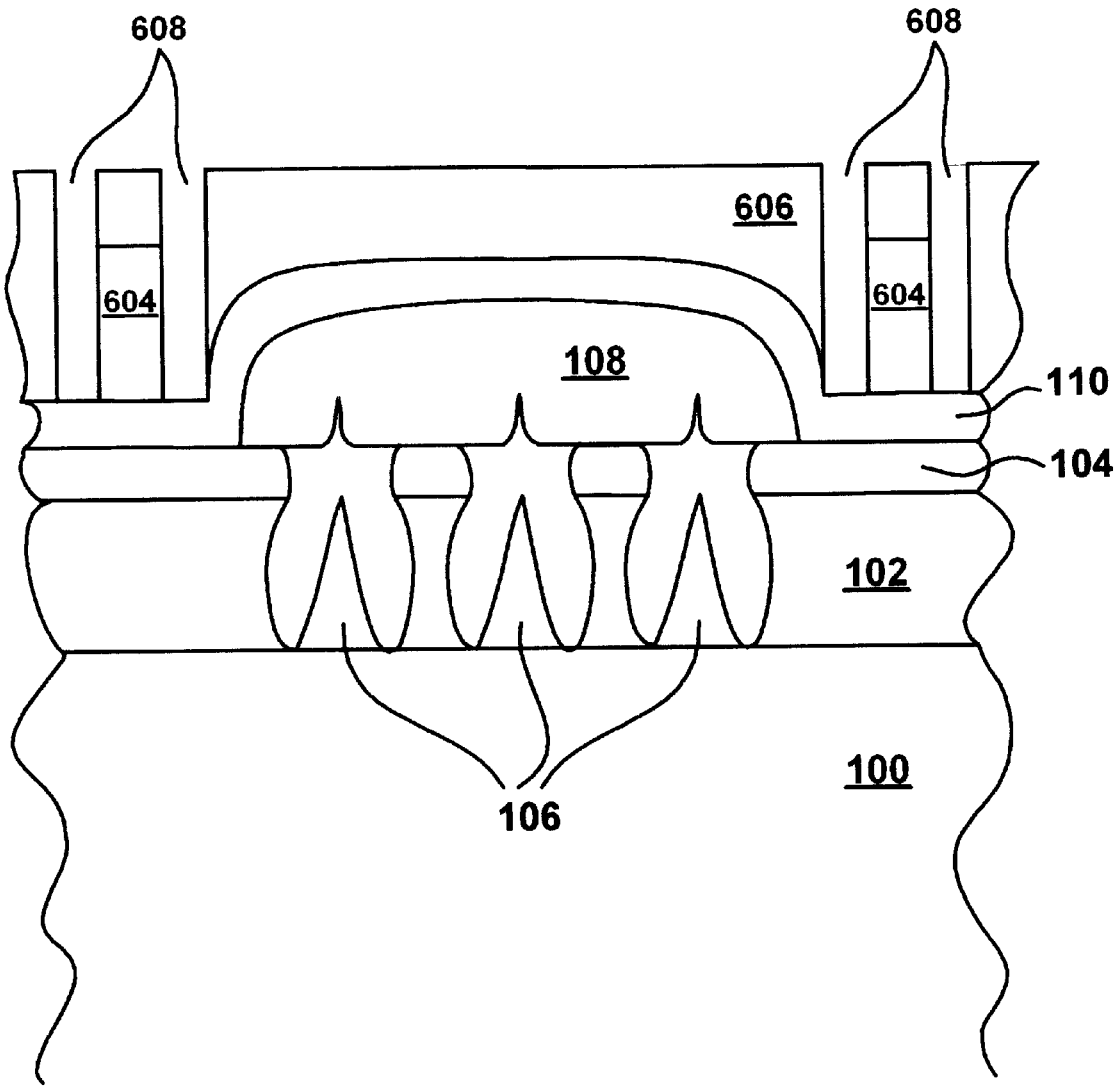
FIG. 6I shows a side sectional view of the structure of FIG. 6H having openings formed in the second layer of photo-imagable material in accordance with one embodiment of the present claimed invention.

With reference next to FIG. 6H, in the present embodiment of the invention, a second layer 606 of photo-imagable material is applied above dielectric layer 110 of the cathode portion and above the conductive structures 604 of FIG. 6G.

With reference next to FIG. 61, after the deposition of layer of photo-imagable material 606, layer of photo-imagable material 606 is subjected to a second exposure process. After the second exposure process, the present embodiment removes portions of layer of photo-imagable material 606, such that openings, typically shown as 608 in the side sectional view of FIG. 61, are formed in layer of photo-imagable material 606. In the present embodiment, openings 608 form the second part of a template for the formation of a conductive focus waffle structure. That is, openings 608 are disposed in a grid pattern comprised of substantially orthogonally oriented rows and columns. Furthermore, although only two sets of openings, 608, are shown in FIG. 61 for purposes of clarity, it will be understood that numerous rows and columns of openings will be formed into layer of photo-imagable material 606.

Figure 6J:
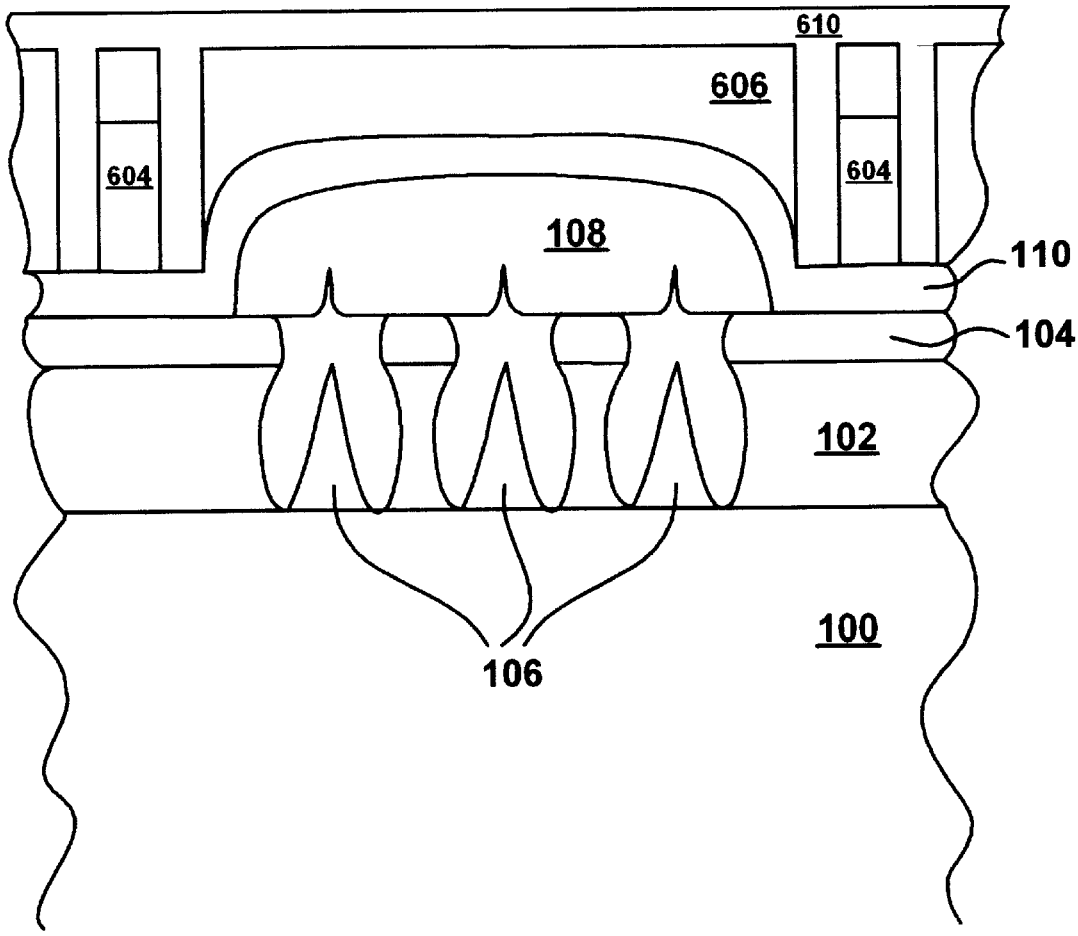
FIG. 6J shows a side sectional view of the structure of FIG. 6I having a second conductive layer disposed over the second layer of photo-imagable material and into the openings formed therein in accordance with one embodiment of the present claimed invention.

Referring now to FIG. 6J, after the formation of openings 608 of FIG. 61, the present embodiment applies a second layer of conductive material 610 over layer of photo-imagable material 606 and into openings 608 formed therein. As shown in FIG. 6H, second layer of conductive material 610 is electrically insulated from conductive gate electrode layer 104 by layer of insulating material 110.

Figure 6K:
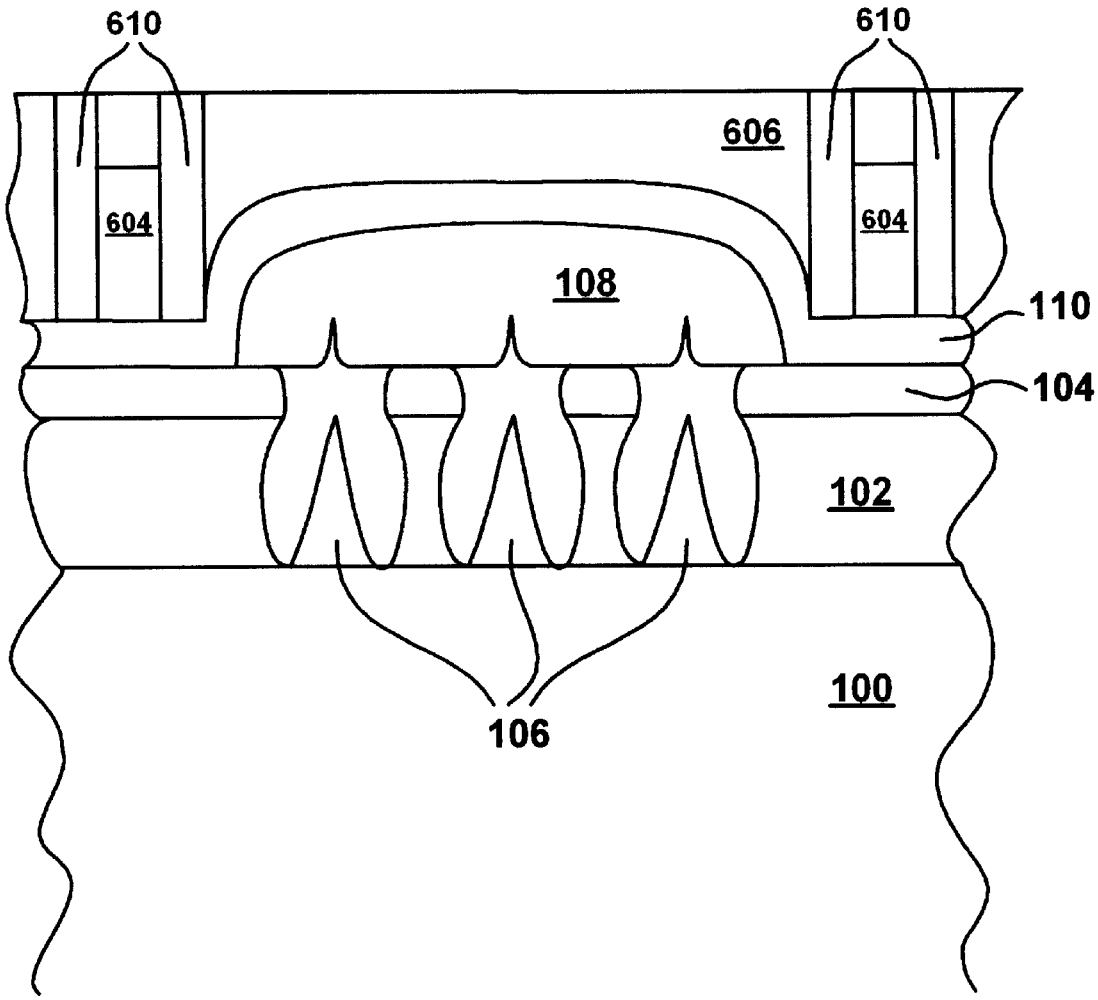
FIG. 6K shows a side sectional view of the structure of FIG. 6J having excess portions of the second conductive layer removed therefrom in accordance with one embodiment of the present claimed invention.
Figure 6L:
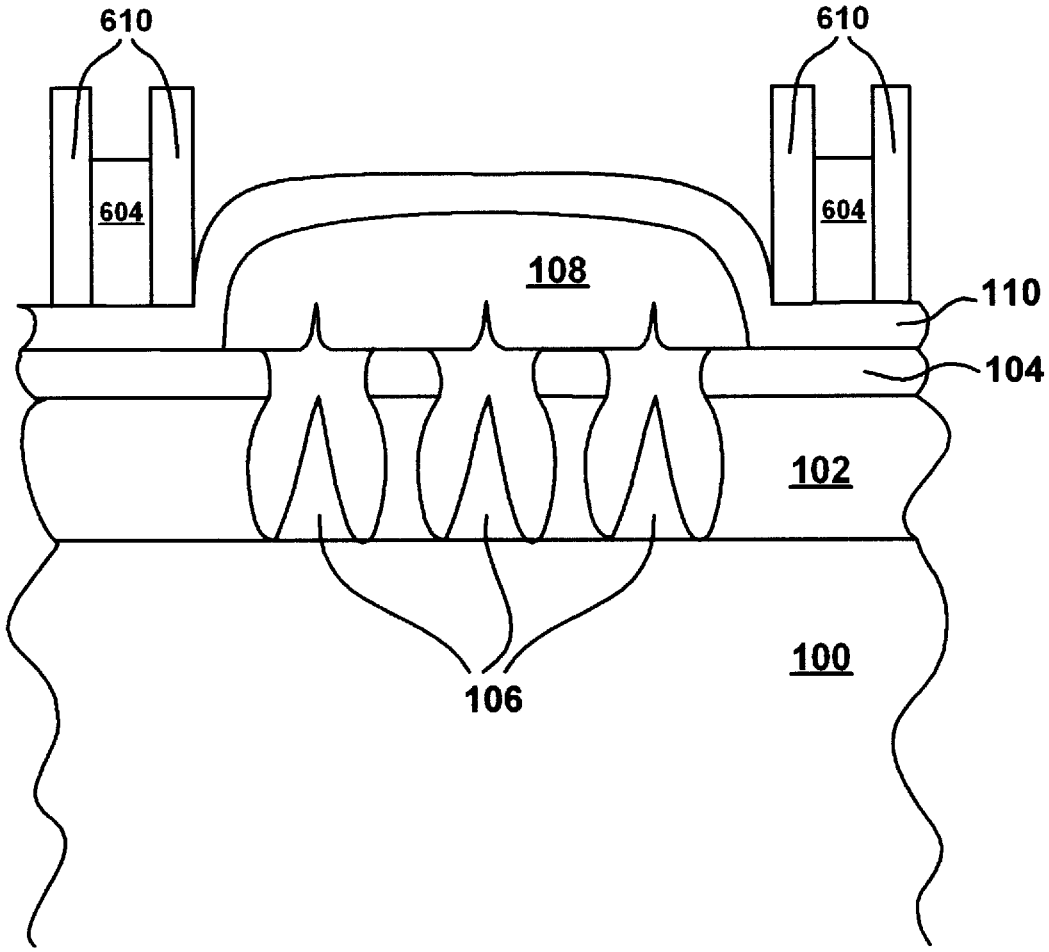
FIG. 6L shows a side sectional view of the structure of FIG. 6K having remaining portions of the second photo-imagable layer of material removed therefrom in accordance with one embodiment of the present claimed invention.

With next to FIG. 6K, in one embodiment of the present invention, excess conductive material disposed on top of and/or into openings 608 in layer of photo-imagable material 606 is removed by wiping off (e.g. "squeegeeing" and the like) the conductive material from the top surface of layer of photo-imagable material 606. In so doing, the present embodiment insures that second layer of conductive material 610 is at a desired depth within openings 608 in layer of photo-imagable material 606. After the removal of excess conductive material, second layer of conductive material 610 is hardened. In another embodiment, excess conductive material disposed on top of and/or in openings 608 in layer of photo-imagable material 606 is removed by mechanically polishing off the excess amounts of the conductive material after the hardening process. Again, such an approach insures that the conductive material is deposited to a desired depth within openings 608 in layer of photo-imagable material 606.

Referring now to FIG. 61, after second layer of conductive material 610 is hardened, the present invention removes remaining portions of layer of photo-imagable material 606. After the removal of the remaining portions of layer of photo-imagable material 606, first and second portions (i.e. 604 and 610) of conductive rows and columns remain disposed above layer of insulating material 110.

Figure 6M:
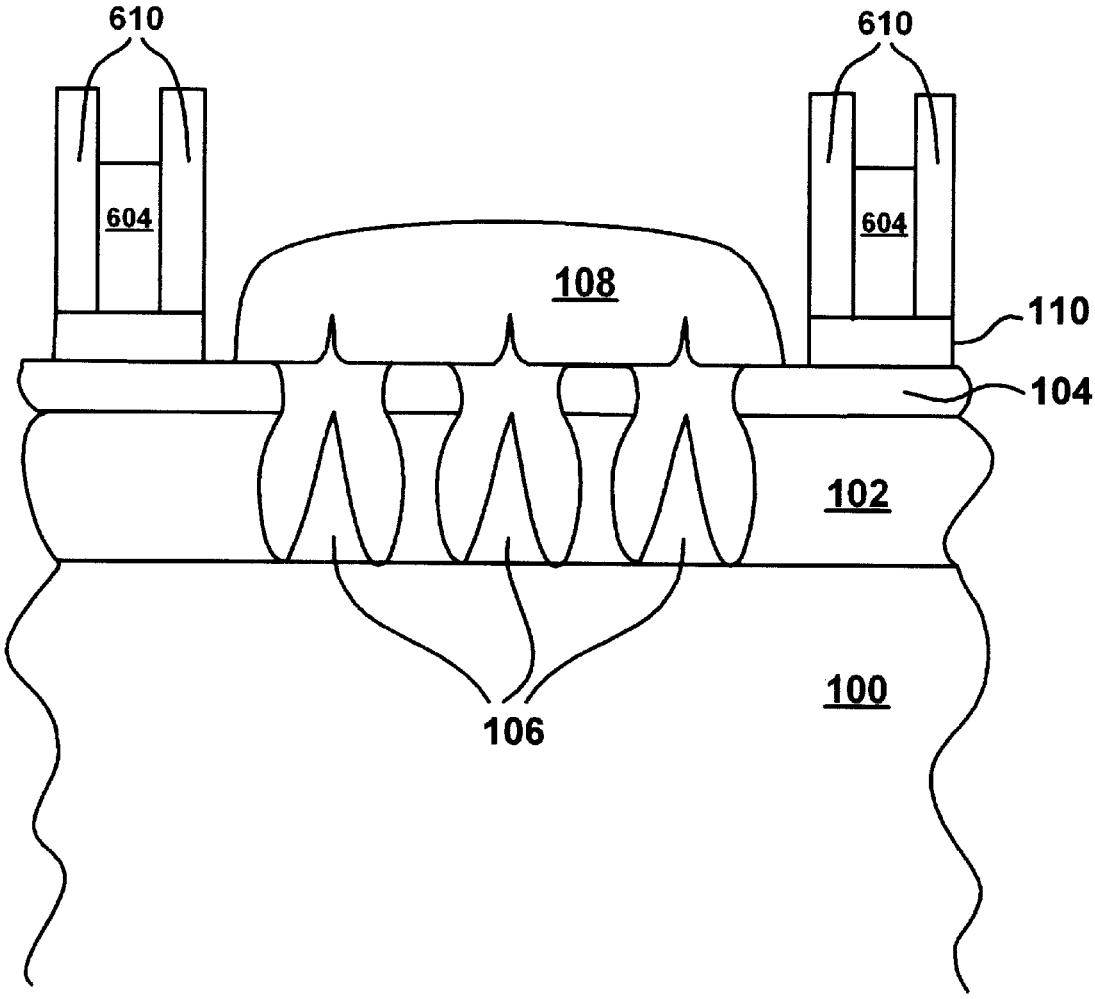
FIG. 6M shows a side sectional view of the structure of FIG. 6L having various portions of the insulating layer of material removed therefrom in accordance with one embodiment of the present claimed invention.

As shown in FIG. 6M, after the removal of the remaining portions of layer of photo-imagable material 606, the present embodiment removes layer of insulating material 110 except for those portions of layer of insulating material 110 which directly underlie conductive rows and columns 604 and 610. As a result, the present embodiment provides a complete conductive focus waffle structure which is electrically insulated from conductive gate electrode layer 104 by portions of layer of insulating material 110. Moreover, the conductive focus waffle structure of the present embodiment includes a lower dielectric portion (comprised of a portion of layer of insulating material 110) and an upper conductive portion (604 and 610).

As a result of the multi-leveled shape of the present embodiment, the conductive focus waffle structure of FIG. 6M is well suited to having taller portions 610 buttress a support structure disposed along shorter portions 604. That is, a wall, rib, or another support structure commonly located on shorter portion 604 is stabilized or buttressed by taller proximately located portions 610.

Additionally, although the embodiment of FIGS. 6A–6M recites having a layer of insulating material 110 disposed over the cathode structure prior to the deposition of the either the first or second layers of photo-imagable material, the present embodiment is also well suited to an embodiment in which dielectric or insulating material is deposited into openings formed in the first and/or second layers of photo-imagable material prior to the deposition of the first and/or second conductive layers of material. Furthermore, the present invention is also well suited to an embodiment in which the only the row portions or only the column portions of the conductive focus waffle structure are multi-level.

Thus, the present invention provides a focus waffle structure which does not suffer from significant contaminate emission and outgassing. The present invention further provides a focus waffle structure which also eliminates the requirement for complex and difficult angled evaporation processing steps. Additionally, the present invention also invention provides a focus waffle structure which improves focus waffle manufacturing throughput and yield.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order best to explain the principles of the invention and its practical application, to thereby enable others skilled in the art best to utilize the invention and various embodiments with various modifications suited to the particular use contemplated. It is intended that the scope of the invention be defined by the Claims appended hereto and their equivalents.

What is claimed is:

1. A conductive focus waffle structure for focusing electrons emitted from a cathode portion of a flat panel display device, said conductive focus waffle structure comprising:

a grid of material, said grid comprised of substantially orthogonally oriented rows and columns, said substantially orthogonally oriented rows and columns defining openings therebetween, said openings having sufficient size to allow electrons emitted from a cathode portion of a flat panel display device to pass therethrough, said grid further comprising:

a lower dielectric portion adapted to be coupled to said cathode portion of said flat panel display device;

an upper conductive portion coupled to said lower dielectric portion, said upper conductive portion adapted to focus said electrons passing through said openings; and wherein edges of said lower dielectric portion are substantially flush with edges of said upper conductive portion and said upper conductive portion is substantially thicker than said lower dielectric portion.

2. The conductive focus waffle structure of claim 1 wherein said lower dielectric portion of said grid of material is comprised of spin-on-glass.

3. The conductive focus waffle structure of claim 1 wherein said upper conductive portion of said grid of material is comprised of DAG.

4. The conductive focus waffle structure of claim 1 wherein rows of said grid are formed having a different height than said columns of said grid.

* * * * *